US006398428B1

(12) United States Patent
Szajewski et al.

(10) Patent No.: US 6,398,428 B1
(45) Date of Patent: Jun. 4, 2002

(54) APPARATUS AND METHOD FOR THERMAL FILM DEVELOPMENT AND SCANNING

(75) Inventors: Richard P. Szajewski; Mark E. Irving, both of Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/571,755

(22) Filed: May 15, 2000

(51) Int. Cl.[7] ..... G03D 13/00
(52) U.S. Cl. ..... 396/575; 396/567; 355/27
(58) Field of Search ..... 396/567–570, 396/578, 575; 355/27–30; 219/216

(56) References Cited

U.S. PATENT DOCUMENTS

| | | | | |
|---|---|---|---|---|
| 4,021,240 A | | 5/1977 | Cerquone et al. | |
| 4,194,826 A | | 3/1980 | Lewis | |
| 5,113,351 A | | 5/1992 | Bostic | |
| 5,350,651 A | | 9/1994 | Evans et al. | 430/21 |
| 5,465,155 A | | 11/1995 | Edgar | |
| 5,519,510 A | | 5/1996 | Edgar | |
| 5,572,285 A | | 11/1996 | Takagi | 355/27 |
| 5,587,767 A | | 12/1996 | Islam et al. | |
| 5,627,016 A | | 5/1997 | Manico | |
| 5,664,253 A | | 9/1997 | Meyers | |
| 5,698,365 A | | 12/1997 | Taguchi et al. | |
| 5,745,811 A | * | 4/1998 | Okino et al. | 396/567 |
| 5,756,269 A | | 5/1998 | Ishikawa et al. | |
| 5,790,277 A | | 8/1998 | Edgar | |
| 5,858,629 A | | 1/1999 | Ishikawa et al. | |
| 5,988,896 A | | 11/1999 | Edgar | |
| 6,022,673 A | | 2/2000 | Ishikawa | |
| 6,048,110 A | | 4/2000 | Szajewski et al. | 396/575 |
| 6,062,746 A | | 5/2000 | Stoebe et al. | 396/575 |

FOREIGN PATENT DOCUMENTS

| | | |
|---|---|---|
| DE | 19956524 | 6/2000 |
| EP | 0 800 114 A2 | 10/1997 |
| EP | 1 008 901 A1 | 6/2000 |
| GB | 2 318 645 A | 4/1998 |

* cited by examiner

*Primary Examiner*—D Rutledge
(74) *Attorney, Agent, or Firm*—Paul A. Leipold; Lynne M. Blank

(57) ABSTRACT

The invention relates to an apparatus for thermal development having a receiver for receiving an imagewise exposed thermal film, an accumulator for gathering the film, a drive for advancing the film from the receiver to the accumulator, a heater located between the receiver and the accumulator for developing the film, a compound image scanner for scanning the film after it has been thermally developed, the scanner having a first light source and a fist sensor placed for forming a first electronic record of the image formed on the developed firm by reflection, a second light source and a second sensor placed for forming a second electronic record of the image by an opposing reflection, and a third sensor and a third light source placed for forming a third electronic record of the image formed by transmission, and a lighttight container for the receiver and the heater.

18 Claims, 7 Drawing Sheets

APPARATUS AND METHOD FOR THERMAL FILM DEVELOPMENT AND SCANNING

FIELD OF THE INVENTION

The present invention relates to a method and apparatus for processing thermally developable film and electronically extracting scene information from that film. It particularly relates to a compact apparatus and method for developing film by applying heat to the film.

BACKGROUND OF THE INVENTION

In the conventional practice of color photography, silver halide film is developed by a chemical technique, requiring several steps consisting of latent image development, bleaching, and fixing. While this technique has been developed over marry years and results in exceptional images, the technique requires several liquid chemical solutions and precise control of times and temperatures of development. Further, the conventional silver halide chemical development technique is not particularly suitable for utilization with compact developing apparatus. The chemical technique also is not easily performed in stand alone units as might be appropriate for self-operated kiosks, the home or the small office.

The method of electronic film development has been proposed as an alternative to conventional wet process methods. In this method, a conventional color film is developed by applying a viscous black-and-white developer solution under a laminate. Density formation during and following development is monitored by a sequence of both infrared transmission and reflection scans. The reflection scan of the front surface of a film is said to represent a blue color record, while the reflection scan of the rear surface of a film is said to represent a red color record. The transmission scan is said to represent the sum of the red, green and blue color records. The green color record is then said to be extractable by difference. This method, as described in Edgar U.S. Pat. Nos. 5,465,155; 5,519,510; and 5,790,277, is inadequate in that development is inherently uneven and leads to uncorrectable defects in the formed images. It has recently been proposed by Edgar U.S. Pat. No. 5,988,896 that the method can be improved by the expedient of applying developer solution by means of micro-droplets instead of by viscous solution and lamination. However, development remains functionally uncontrolled. In the improved method, only limited quantities of developer solution are applied because application of excess developer solution in the form of micro-droplets still leads to non-uniformity of development and run-off. The required quantity of developer solution required in each area of film is ultimately determined by the exposure in that area. Since the exposure cannot be determined until after development, high exposure areas are under supplied with developer or low exposure areas are oversupplied with developer with the result that highly exposed regions are underdeveloped while low exposure areas are overdeveloped with variation in density formation corresponding to the pattern of droplet application. The effect can be especially apparent under conditions of high magnification as is required for the production of prints from films designed to be employed in hand held cameras.

Imaging systems that do not rely on conventional wet processing have received increased attention in recent years. Photothermographic imaging systems have been employed for producing silver images. Typically, these imaging systems have exhibited very low levels of light sensitivity and hive been utilized primarily where only low imaging speeds are required. The most common use of pbotothermographic elements is for copying documents and radiographic images. A method and apparatus for heat developing microfilms is disclosed in Lewis U.S. Pat. No. 4,194,826, while a method and apparatus for heat developing sheet films is disclosed in Islam et al U.S. Pat. No. 5,587,767. Summaries of photothermographic imaging systems are published in *Research Disclosure*, Vol. 170, June 1978, Item 17029, and Vol. 299, March 1989, Item 29963. Thermally developed films have not been generally utilized in camera speed color photography due to the difficulties of forming optically printable color images from heat development color photographic materials. Several approaches have been proposed, for example, by Cerquone et al U.S. Pat. No. 4,021,240; by Taguchi et al U.S. Pat. No. 5,698,365; by Ishikawa et al U.S. Pat. Nos. 5,756,269 and 5,858,269; and in U.K. Publication 2,318,645. These all rely either on partial wetting and lamination and image transfer schemes or on optical color printing or scanning through both developed silver and formed dye. The image transfer schemes are suitable for directly producing prints. However, they are not suitable for images that need to be magnified, as for example images captured on roll films sized to be loaded into cameras, since these images lose resolution or detail in being transferred from a donor to a receiver sheet. This resolution loss is visually objectionable. Examples of low sensitivity, low-resolution commercial products include Color Dry silver supplied from Minnesota Mining and Manufacturing Co. and PICTROGRAPHY® and PICTROSTAT® supplied by Fuji Photo Film Co., Ltd. Optical color printing and color scanning both require transmitting light through an image. The transmitted light may be used to directly expose another film or its intensity may be measured electronically and the electronic record of the transmitted light may be digitized and stored as an electronic file representation of the film image. These techniques are not readily applied to photothermographic films because of the high formed densities and because the color records are all contaminated by undeveloped silver and by imagewise black silver density deposits that cannot be unambiguously associated with distinct color records.

PROBLEM TO BE SOLVED BY THE INVENTION

There is a need for a compact, camera speed color film development and reading system that can be utilized in stand-alone units as might be appropriate for self-operated kiosks, the home or the small office. There is a further need for a compact thermal development film development and reading system with the capability to scan the thermally developable film having both silver density and independent color records.

SUMMARY OF THE INVENTION

It is an object of the invention to overcome disadvantages of prior apparatus and processes for thermal film and the complicated, awkward procedures for wet-processing conventional films.

It is another object to provide an improved method of development of thermal film in a thrust cartridge.

It is mother object to provide more convenient and rapid processing of thermal film to the individual user.

It is another object to provide a means to scan the thermal film.

It is yet a further object to provide simplified films suitable for scanning.

It is yet another object of this invention to provide a method of scanning simplified films.

These and other objects of the invention are accomplished by an apparatus for thermal development having a receiver for receiving an imagewise exposed thermal film, an accumulator for gathering the film, a drive for advancing the film from the receiver to the accumulator, a heater located between the receiver and the accumulator for developing the film as it passes between the receiver and the accumulator, an image scanner for scanning the film after it has been thermally developed, the scanner having a first light source and a first sensor placed for forming a first electronic record of the image formed on the developed thermal film by reflection, a second light source and a second sensor placed for forming a second electronic record of the image formed on the developed thermal film by an opposing reflection, and a third sensor and a third light source placed for forming a third electronic record of the image formed on the developed thermal film by transmission; wherein the third sensor may be the same or different than the first sensor and the third light source may be the same or different than the second light source; and a lighttight container for the receiver and the heater.

The objects of the invention are additionally provided by an image forming method comprising the step of scanning an imagewise exposed and thermally developed silver halide film element to form a first electronic record of the image formed on the developed thermal film by reflection, a second electronic record of the image formed on the developed thermal film by an opposing reflection and a third electronic record of the image formed on the developed thermal film by transmission.

The objects of the invention are further provided by a light sensitive silver halide color thermal film element comprising red, green and blue light sensitive layer units wherein the layer units form reflective images of substantially similar color on thermal development or wherein the element is substantially free of color forming components.

ADVANTAGEOUS EFFECT OF THE INVENTION

The invention provides a compact, convenient apparatus and method for processing of film, especially camera speed film contained in a thrust cartridge. It provides a means to scan the thermal film to form an electronic record of image data that may be readily processed, printed, and transmitted. It provides a means to record and write magnetic information to effect optimal subsequent processing. It provides an apparatus and a method of processing of color thermal films that is convenient, compact and overcomes the need for wet chemicals, water and sewer hookups and constant operator attention while overcoming the shortfalls inherent in previous thermal films and processes.

DETAILED DESCRIPTION OF THE INVENTION

The invention has numerous advantages over prior methods of processing thermal film, particularly thermal film provided with means to store magnetic information contained in thrust cartridges. The system of the invention has the advantage that the individual user of thermal film cartridges may process the cartridges in a convenient and low-cost system. The apparatus of the invention has the advantage that magnetic information may be sensed and written on to the film. This information may be used to control subsequent processing or optical scanning. The invention has the advantage that it provides an optical scanner to create an electronic file record of film image information. The optical scanner operates by both transmission and reflection in the infrared region to individually interrogate distinct color records without the record cross talk inherent in previously known methods. The invention provides an apparatus that is low in power requirements and which avoids the use of chemicals and costly utility hooks, while producing rapid developing for the individual user in a variety of settings. These and other advantages will be apparent from the detailed description below.

Figure 1:
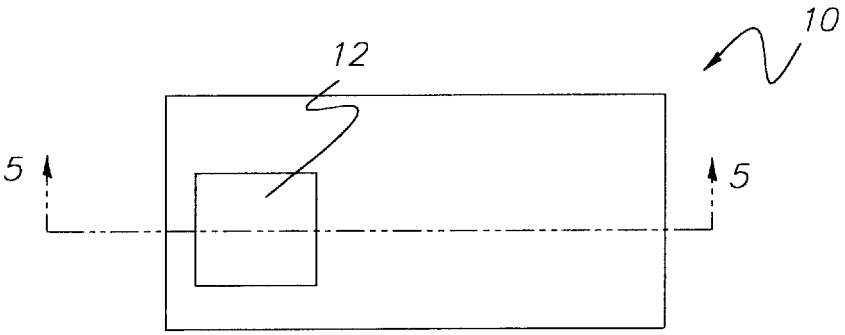
FIG. 1 is a top view of a thermal development apparatus of the invention.
Figure 2:
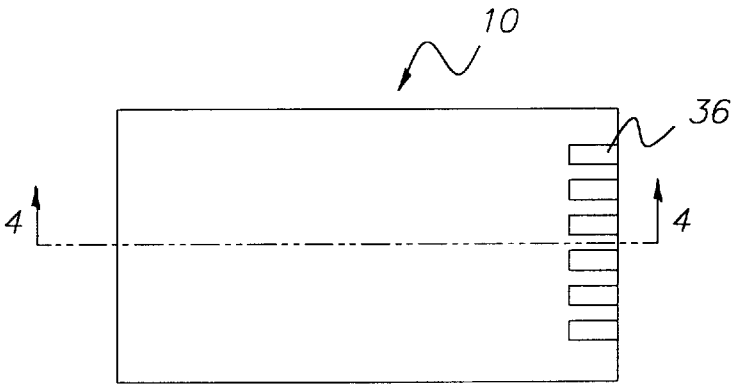
FIG. 2 is a side view of the apparatus of the invention.
Figure 3:
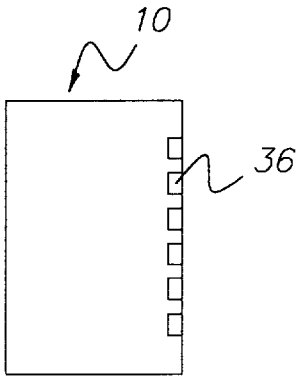
FIG. 3 is an end view of the apparatus of the invention.

As illustrated in FIGS. 1, 2, and 3, there is provided compact development apparatus device 10. The apparatus 10 is lighttight so that the thermal film is not exposed to light prior to the thermal development. The apparatus has a lighttight door 12 for opening and inserting a thrust cartridge. The apparatus 10 further is provided with electrical contacts 36 for providing power and control to the apparatus. In another embodiment, the development apparatus can be hardwired to a power source and to a controller.

Figure 4:
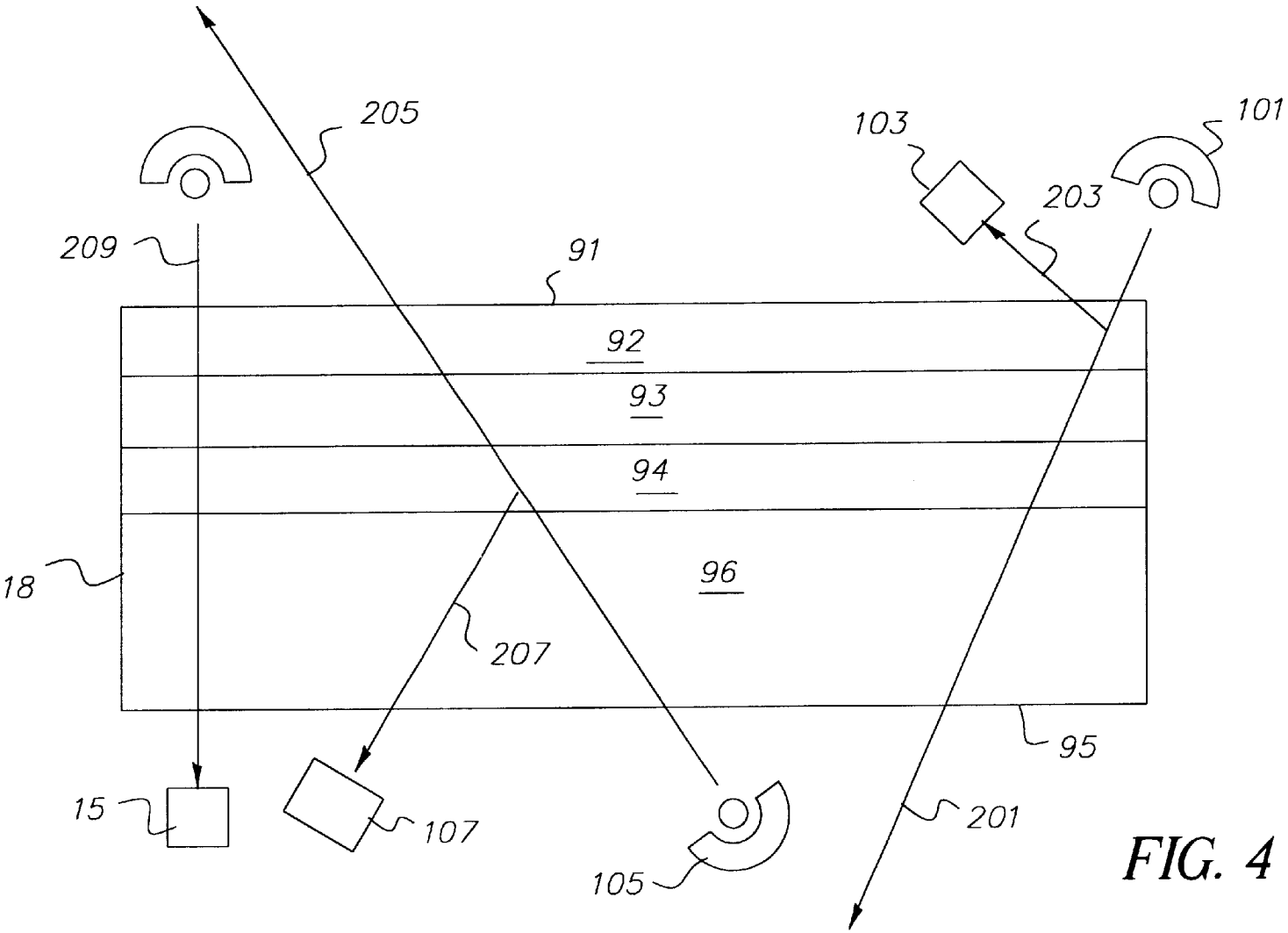
FIG. 4 is a schematic view of a multiple head scanner for measuring both transmission and reflection scans.

A scanner utilizes a light source to provide illumination and an optical detector, or sensor, to determine the optical density of the film by measuring the quantity of light delivered to the sensor after the light interacts with the imagewise developed film. An imagewise scan of a film image frame can be obtained by using an appropriate light source and a linear detector array that scans the entire width of the film as the film is driven past the scanning apparatus. In FIG. 4, a developed color sensitive film 18 is shown in relation to a compound scanner having multiple light sources and multiple light sensors that are arranged to allow both reflection and transmission scanning. The film 18, in addition to having a surface 91 and an opposing surface 95, has color sensitive layer units that independently form density during a development step as a function of exposure to light of specific colors. In a preferred embodiment, layer unit 92 forms imagewise density during a development step in response to blue light, layer unit 93 forms imagewise density during a development step in response to green light and layer unit 94 forms imagewise density during a development step in response to red light. The film additionally has a support 96 as well as auxiliary layers that are not shown. The scanner has a first light source 101 that emits light 201 and a first light sensor 103 placed for forming a first electronic record of the image formed on the developed thermal film by reflection of light 203 from layer unit 93 in proximity to a film surface. The scanner has a second light source 105 that emits light 205 and a second light sensor 107 placed for forming a second electronic record of the image formed on the developed thermal film by light 207 reflected from layer unit 94 in proximity to opposing film surface 95. The scanner has a third light source 9 that emits light 209 and a third light sensor 15 placed for forming a third electronic record of the image formed on the developed thermal film by transmission of light 209. The placement and the angle of the light source and light sensor with respect to the film controls the depth into the film from which reflected light is collected by the scanner operating in reflection mode. The mechanical arrangement of the light sources and light sensors can be optimized for cost and compactness by using a common light source to illuminate more than one sensor. Likewise, a common light sensor may be illuminated by more than one light source. In this situation, the light sources and light sensors can be activated and deactivated in sequence to avoid cross talk between the independent color records recorded on the developed film. One reflection scan measures the image densities associated with a color layer unit in proximity to a film surface. The second reflection scan measures the image densities associated with a color layer unit in proximity to the opposing film surface. These reflections of light from layer units in proximity to opposing film surfaces are called opposing reflections. The transmission scan measures the total density formation and, by difference the densities associated with a layer unit between the layer units in proximity to the individual film surfaces. The image density data collected by these multiple scans can be combined and reformed into a single record representative of the original scene captured by film 18 using mathematical algorithms as known in the aft.

Figure 5:
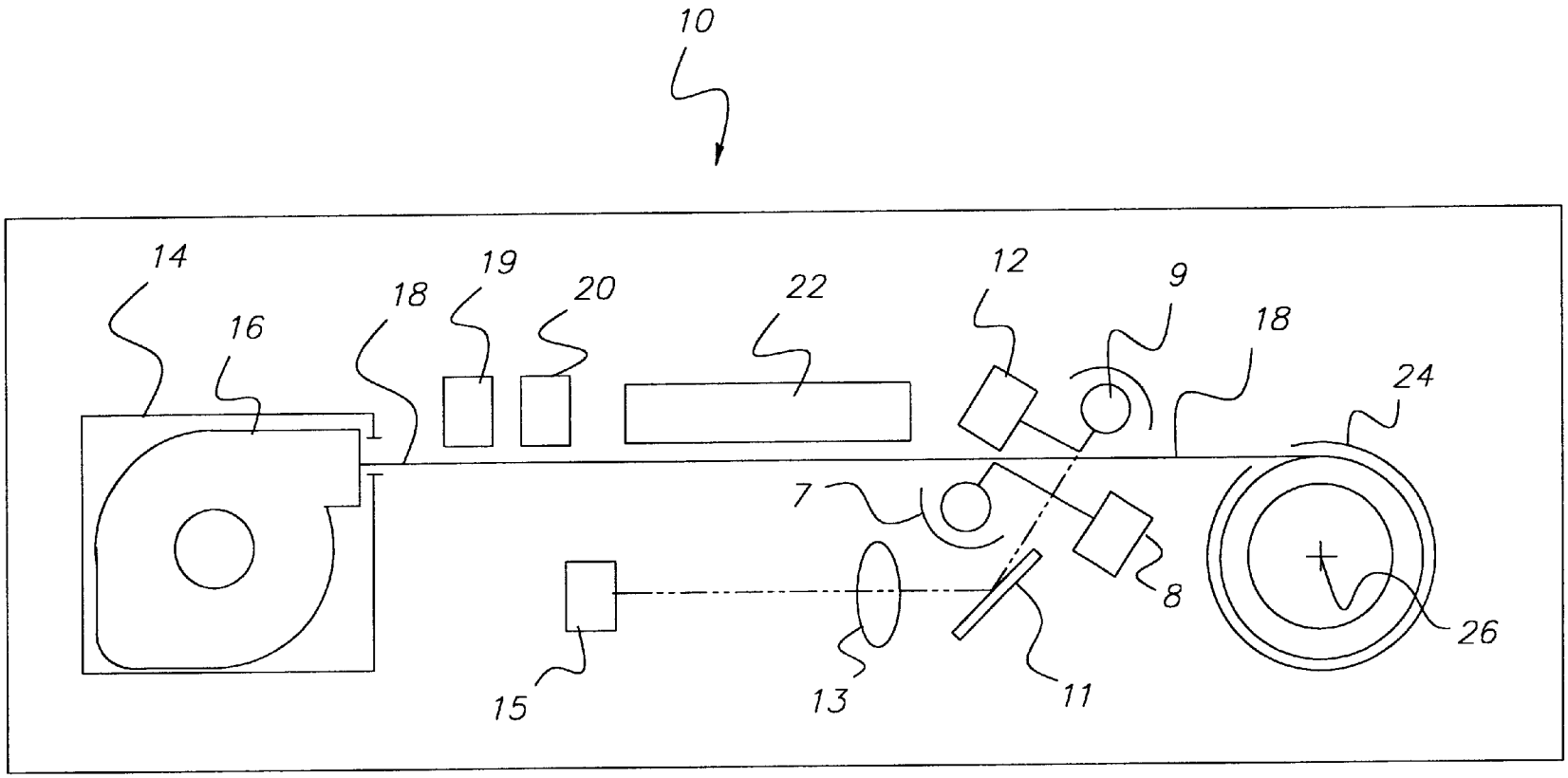
FIG. 5 is a cross-sectional view on line 4—4 of FIG. 2.

As shown in FIG. 5, the device 10 contains a chamber 14 for receiving the thrust cartridge 16. The thrust cartridge as it is unwound has film 18 pass into accumulator 24. The film 18 is then wound into accumulator 24. In a compact design, motor 26 located within the accumulator 24 drives the thrust cartridge spool. The film 18 is shown to pass between a light source 9 and a mirror 11 as the film 18 is thrust from the thrust cartridge 16 to the accumulator 24. The light generated by light source 9 and transmitted through the film 18 is reflected by minor 11 and focused by lens system 13 to be detected by optical detector or light sensor 15. In other embodiments, the mirror and lens can be modified or omitted as known in the art. The light from light source 9 that is reflected from a film layer unit is detected by light sensor 12. The light from light source 7 that is reflected from a film layer unit is detected by light sensor 8. The use of two light sources and three sensors as shown in FIG. 5 is an example of employing one light source to drive two sensors, one by transmission and one by reflection. It should be noted that the film layer order as it relates to the support 96, the light source 9 and sensor 15 of FIG. 4 and the same components of FIG. 5 have been reversed to illustrate that distinct arrangements of film layer orders, light sources and sensors are useful in the invention. It should further be noted that the light sources and light sensors can all be placed in proximity to one face of the film and the color record monitored by reflection from all color records. While light of any color can be employed to measure both transmission and reflection, infrared light is preferred when color light sensitive films that form distinct colored images and neutral silver images on development are to be scanned. The formed organic dyes which are typically intended for human viewing are transparent in the infrared region and the expedient of choosing infrared light for the transmission and reflection scans offers the advantage of minimizing cross-talk between the superimposed color records. The electronic record of the film image data may be created by recording the output of the light sensors in relation to the relative position of the film image frame and the optical scanner.

Figure 6:
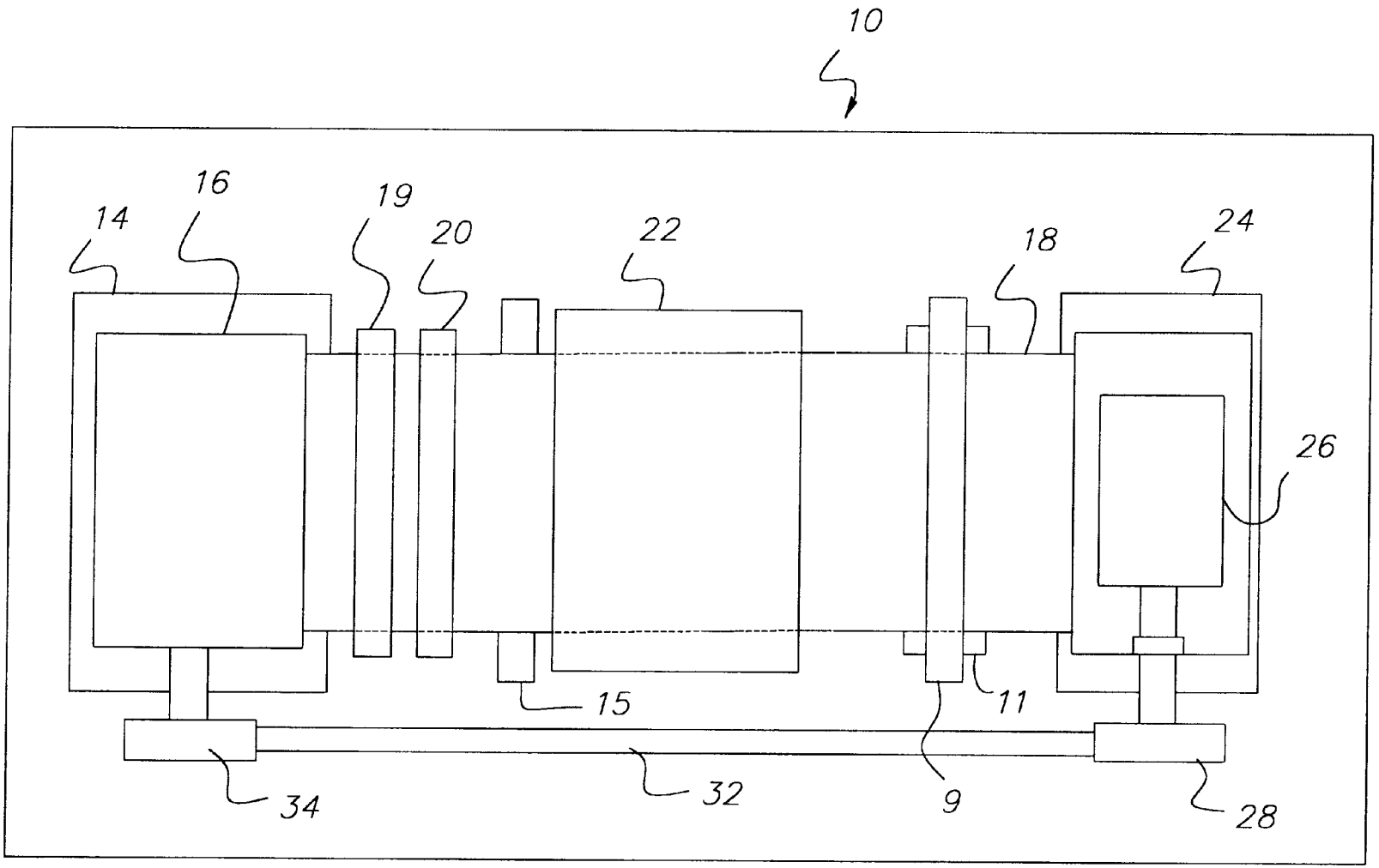
FIG. 6 is a cross-sectional view on line 5—5 of FIG. 1.

In FIG. 6, motor 26 acts to drive film from cartridge 16 and to rewind film into cartridge 16. Motor 26 turns sprocket 28 through a series of gears 32 to sprocket 34 that drives film from thrust cartridge 16 as it is wound into accumulator 24. As the film 18 passes between the thrust cartridge 16 in the receiver and the Accumulator 24, it passes over a heater 22. As the film 18 passes between the thrust cartridge 16 in the receiver and the accumulator 24, it passes over a magnetic reading head 19 and a magnetic writing head 20 as well as past the scanner light source 9. Portions of the compound scanner have been omitted for clarity.

Figure 7:
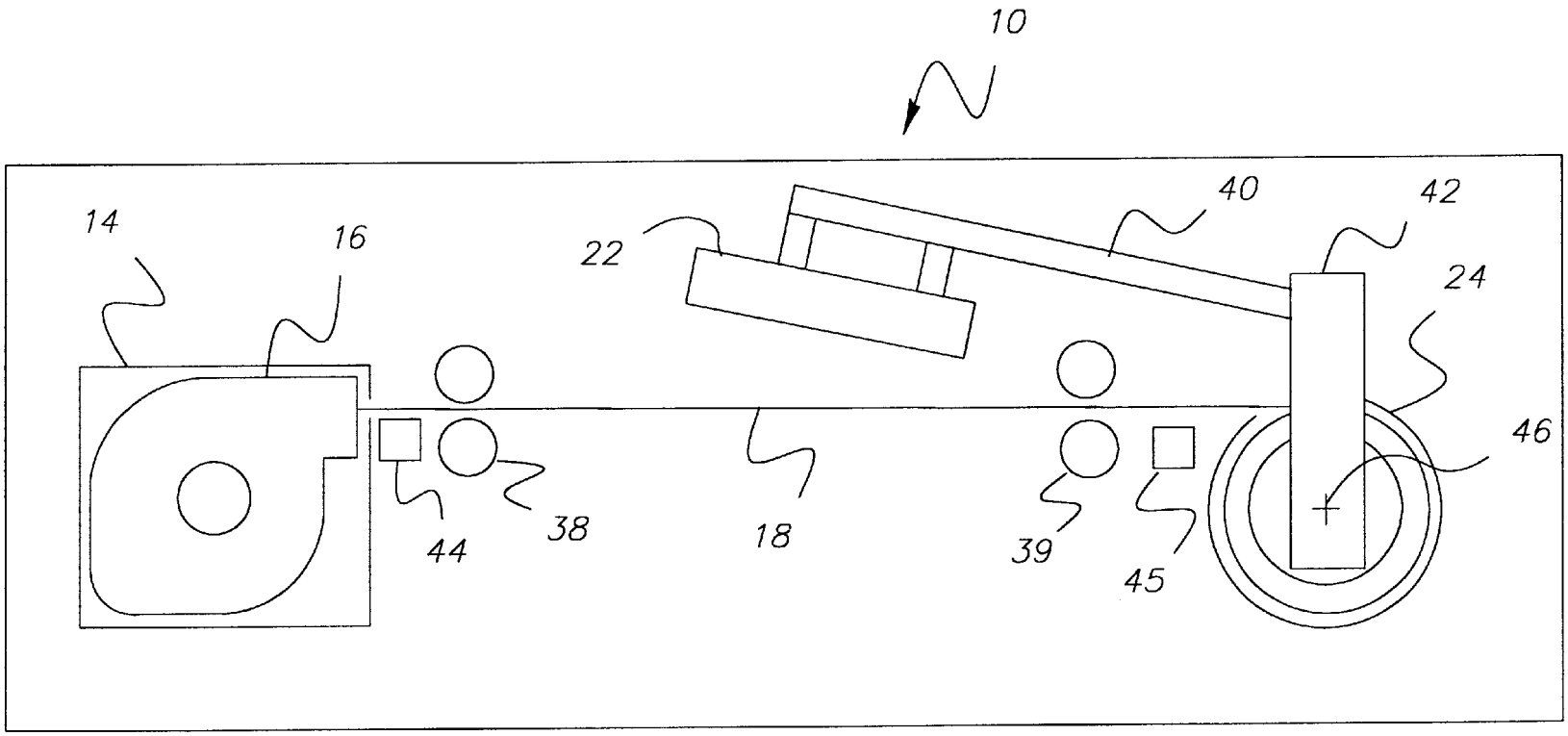
FIG. 7 is an alternative cross-sectional view on line 4—4 of FIG. 2 showing means to remove the heater from film path.
Figure 8:
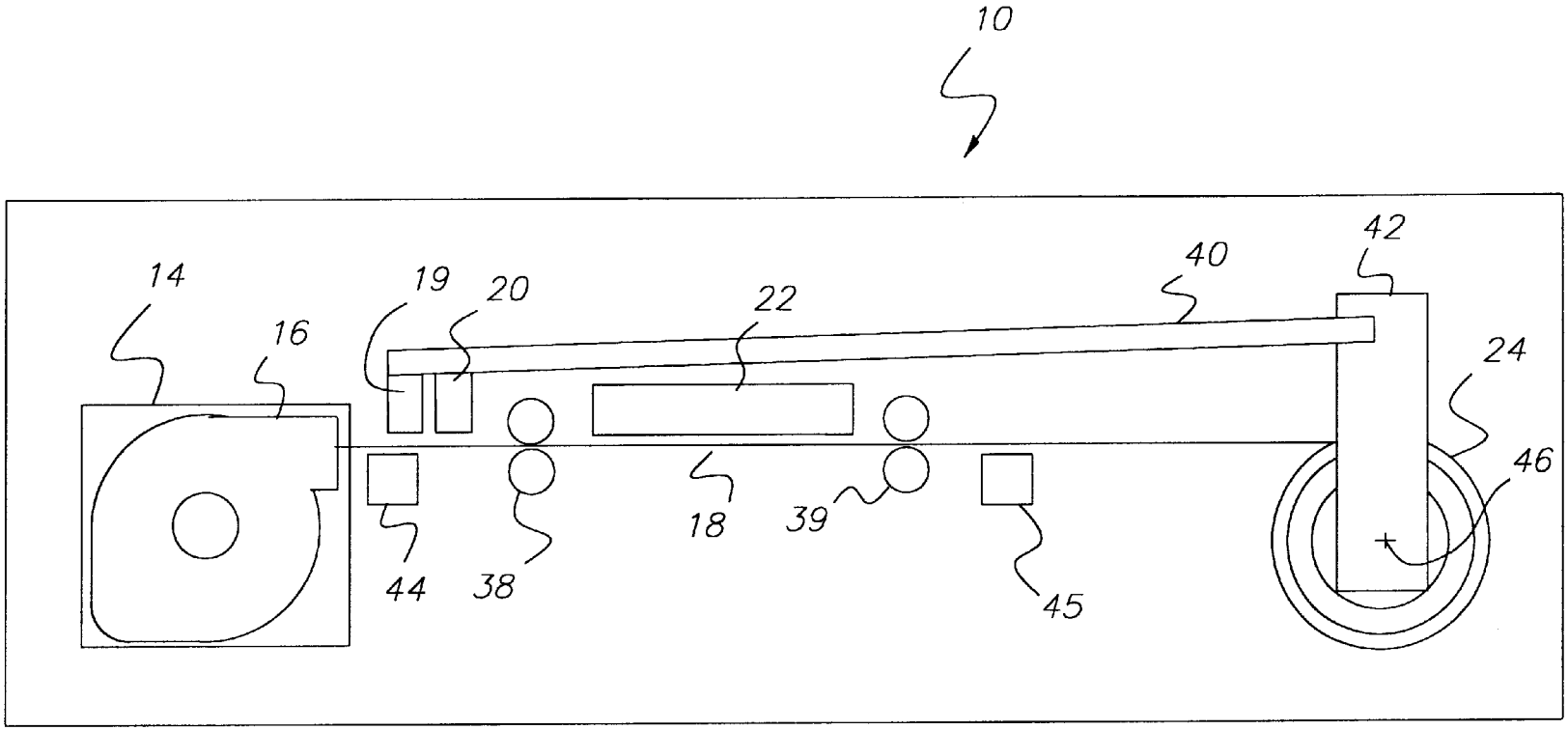
FIG. 8 is an alternative cross-sectional view on line 4—4 of FIG. 2 showing means to remove the magnetic reader and magnetic writer from film path.

In FIG. 7, the film 18 is shown to pass through guide rollers 38 and 39, and the heater 22 is shown to be supported by an armature 40 that may be actuated by a motor 46 located within the accumulator 24 through an assembly of gears 42 to translate the heater 22 into and out of close proximity to the path of the film 18. The mechanism is constructed to actuate the armature in response to preset conditions or in response to signals provided by sensors 44 and 45. Sensors 44 and 45 are designed to monitor a plurality of parameters including film speed, film location, temperature, frame advancement, and fault conditions such as film breakage, film jam, and heater malfunction In FIG. 8, the film 18 is shown to pass through guide rollers 38 and 39, and the magnetic writing head 20 and magnetic reading head 19 are shown to be supported by an armature 48 that may be actuated by a motor 46 through an assembly of gears 42 to translate the magnetic writing head 20 and the magnetic reading head 19 into and out of close proximity of the path of the film. The mechanism is constructed to actuate the mechanism in response to preset conditions or in response to signals provided by the magnetic reading head 19 or sensors 44 and 45. Sensors 44 and 45 are designed to monitor a plurality of parameters including film speed, film location, temperature, frame advancement, and fault conditions such as film breakage, film jam, and heater or magnetic reader or magnetic writer malfunction.

Figure 9:
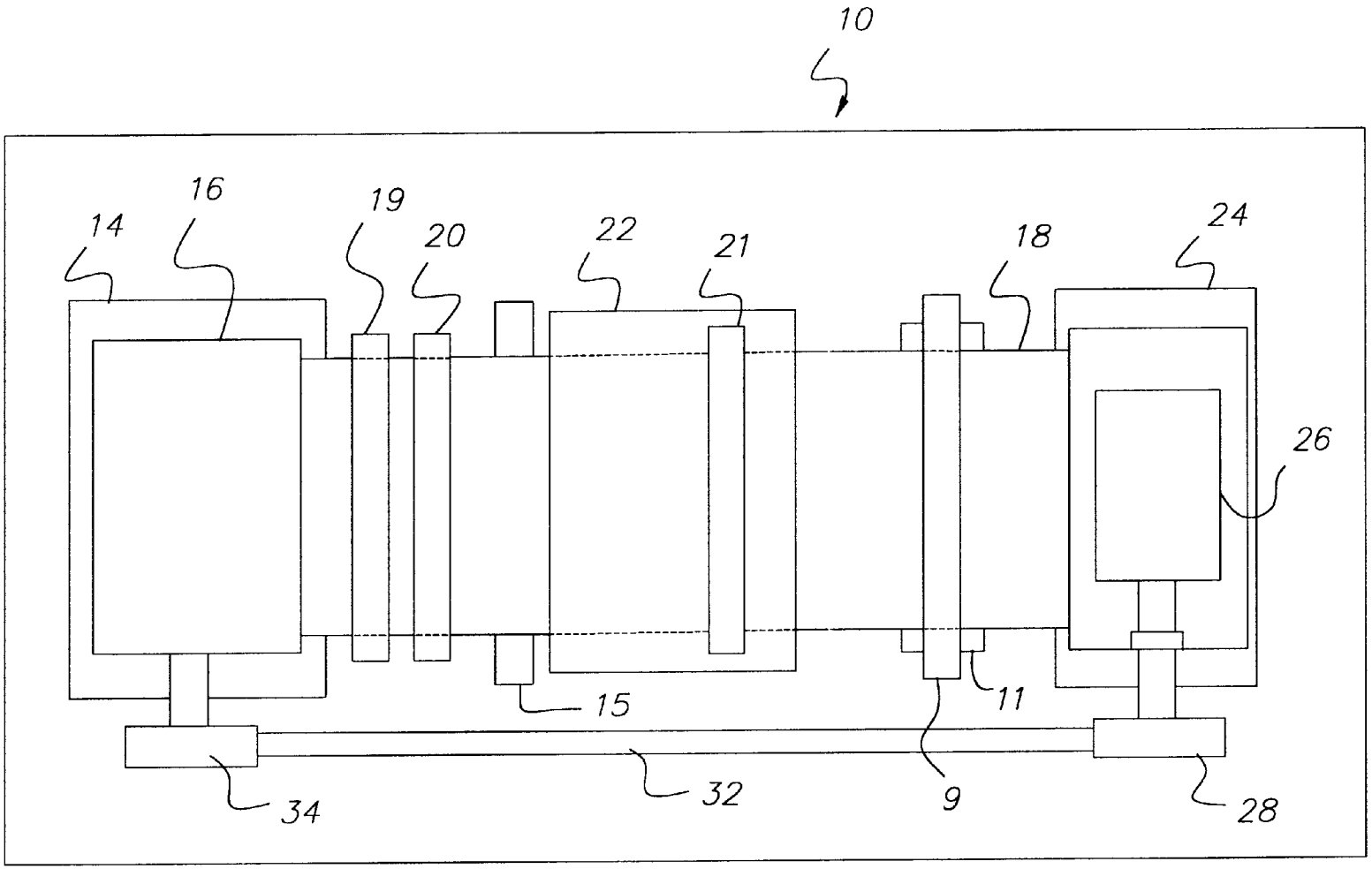
FIG. 9 is an alternative cross-sectional view on line 5—5 of FIG. 1 showing cooling means to preserve magnetic information.

In FIG. 9 the film 18 is shown to pass heater 22 and a chiller 21. Chiller 21 provides cooling to regions of the film containing magnetic information so that the magnetic information is not degraded by the temperature extremes of the thermal processing conditions.

The heater 22 utilized in the apparatus of the invention can be any suitable type of heater. Heaters for the apparatus include radiant heaters, heated liquid, dielectrics, microwave, conduction, and convection. Preferred for the apparatus of the invention is a resistive heater in the form of a plate, as this provides maximum transfer efficiency for heat to the thermally developable film. Other types of resistive heaters also can be utilized such as a series of heater bars, a rotating drum or a grid. The resistive heater plate preferred for the invention generally is between about 2 and 5 cm in length for reasonable drive speed of the film with adequate exposure time to the temperature of development.

The thrust cartridge can be any cartridge that allows film to be withdrawn from the cartridge and rewound onto the cartridge multiple times while providing lighttight storage, particularly prior to exposure and development. Typical of such cartridges are those utilized in the advanced photo system (APS) for color negative film. These cartridges are disclosed in U.S. Pat. No. 4,834,306—Robertson et al and U.S. Pat. No. 4,832,275—Robertson.

The thermal film elements utilized in the invention can be any film element that provides satisfactory images. Thermal films are characterized in having incorporated light insensitive organic silver salts that are reduced on development and that are distinct from the light sensitive silver halides which are imagewise exposed to detect an image. Useful color thermal films are disclosed by Taguchi et al U.S. Pat. No. 5,698,365; by Ishikawa et al U.S. Pat. Nos. 5,756,269 and 5,858,269, the disclosures of which are incorporated by reference. These thermal films comprise light sensitive silver halides, arranged in layer forming units along with organic components that produce a humanly viewable color image. These components include those that form dyes, those that release dyes, color-forming couplers that react with oxidized developers, and developers that react with couplers to form dye after the developer is oxidized. The films can additionally comprise reducing agents and antifoggants suspended in binders coated on supports. Other components can be included as known in the photographic and photothermographic art. These components may be added in the same layers or in separate layers over the film base. A wide range of colors may be obtained by using in combination at least three silver halide emulsion layers, each having light sensitivity in different spectral regions. The thermal film can be provided with various supplementary layers such as protective layers, undercoat layers, intermediate layers, antihalation layers, and back layers. The respective layers can be variously disposed as known in the usual color photographic materials. Filter dyes may be included in some layers. These described films form both color images in dye and neutral images in silver on thermal development. The color images can be suitable for human viewing and are often highly transparent and poorly reflective. Conversely, the neutral images in metallic silver are only somewhat transparent and highly reflective. It is these neutral images that are scanned by the described compound scanner.

In another embodiment of the invention, the described thermal film element can be formulated with one or more of the humanly visible color forming components omitted. As an example, fall color-forming color sensitive photothermographic film (A), whose detailed preparation and use is described later, can be prepared without image dye forming couplers (1), (2), and (3) to supply a non-color forming color sensitive photothermographic film (B). A non-color forming oxidized developer scavenger can be useful in this situation. On imagewise exposure and thermal development of film (B), distinct silver records are formed in each color record. In contrast, film (A) forms on development color records that differ in color according to the characteristics of the incorporated color forming components along with silver records. The imagewise metallic silver images of element (B) can be scanned using the described compound scanner. Films formulated in this manner form color records of substantially similar color. In this case, the color is essentially a neutral black and consists of developed silver deposits. Such a film is described herein as being substantially free of color forming components. In a preferred embodiment an element that is substantially free of color forming components can incorporate between 0 and 1 $g/m^2$ of color forming components. In a more preferred embodiment the element can incorporate between 0 and 0.1 $g/m^2$ of color forming components. In an even more preferred embodiment the element can incorporate between 0 an 0.01 $g/m^2$ of color forming components. The modified films are environmentally cleaner, cheaper to manufacture and can exhibit improved pre- and post development keeping properties since the organic components necessary to form humanly viewable images which have been omitted are detrimental to keeping.

In a related embodiment, the dye-forming couplers (1), (2), and (3) can be replaced by a single dye-forming coupler chosen to produce micro-crystalline dye deposits. Such couplers are well known in the photographic arts. Specific examples are described by Fernandez et al in U.S. Pat. No. 4,233,389 and by Olbrechts et al in U.S. Pat. No. 5,688,959. These micro-crystalline dyes are highly reflective and their images can be read by the compound scanner.

In yet another embodiment, imagewise exposed non-chromogenic color films, KODACHROME-64 being an example of such a film, can be developed with any known silver forming developer and the resultant silver images scanned using the described compound scanner. Non-chromogenic films developed in this manner are visually neutral. That is, the color records have substantially similar color. Non-chromogenic films are unique in that while they comprise distinct light sensitive layer units, they incorporate no color forming chemistry and rely on coupling developers and couplers supplied during development in order to form humanly viewable color images. The structure and use of non-chromogenic films are reviewed in "50 Years of KODACHROME," and "KODACHROME's Brilliance and Detail," both *Modern Photography*, October 1985 and, in Mannes et al, U.S. Pat. No. 2,252,718. This embodiment supplies images of especially high resolution using a simple non-color forming development process. A non-chromogenic film, like any other film can bead thermal film or not depending on whether or not it contains non-light sensitive organic silver salts that are reduced to form an image on development. In this embodiment, the apparatus can be modified as known in the art to supply the silver forming developer in a developer containing solution or solvent.

In a further embodiment, films that are developed by contacting with a treating element can be employed in the practice of this invention. Films that are made developable in this manner are described in Ishikawa et al, op. cit. and by Ishikawa at U.S. Pat. No. 6,022,673. Other useful films are described by Irving et al, "Packaged Color Photographic Film Comprising a Blocked Phenylenediamine Chromogenic Developer," U.S. application Ser. No. 09/475,510 filed Dec. 30, 1999, the disclosures of which are incorporated by reference. When a film requiring a treating element is employed in the practice of this invention, the described apparatus is modified by the addition of a stage for applying the treating element along with any needed fluids, as taught in the art. The method of developing is modified by the addition of the necessary fluid application step and the necessary treating element application step, again as taught in the art. In these later embodiments where the film is contacted with a solution or a solution is applied or a laminate layer is applied, the heater can be operated for a suitable time at a lower temperature. Temperatures of 35 to 95° C. are preferred and temperatures of 40 to 70° C. are more preferred.

Light sensitive elements or films useful in the practice of this invention can be supplied in standard film cartridges or in thrust cartridges or cassettes. Thrust cartridges are disclosed by Kataoka et al U.S. Pat. No. 5,226,613; by Zander U.S. Pat. No. 5,200,777; by Dowling et al U.S. Pat. No. 5,031,852; by Pagano et al, U.S. Pat. No. 5,003,334 and by Robertson et al U.S. Pat. No. 4,834,306. These thrust cartridges can be employed in reloadable cameras designed specifically to accept them, in cameras fitted with an adapter designed to accept such film cassettes or in one-time-use cameras designed to accept them. Narrow-bodied one-time-use cameras suitable for employing thrust cartridges are described by Tobioka et al U.S. Pat. No. 5,692,221. While the film can be mounted in a one-time-use camera in any manner known in the art, it is especially preferred to mount the film in the one-time-use camera such that it is taken up on exposure by a thrust cartridge.

Elements having excellent light sensitivity are best employed in the practice of this invention. The elements should have a sensitivity of at least ISO 25, preferably have a sensitivity of at least ISO 100, and more preferably have a sensitivity of at least ISO 400. Elements having a sensitivity of ISO 3200 or even higher are specifically contemplated. The speed, or sensitivity, of a color negative photographic element is inversely related to the exposure required to enable the attainment of a specified density above fog after processing. Photographic speed for a color negative element with a gamma of about 0.65 in each color record has been specifically defined by the American National Standards Institute (ANSI) as ANSI Standard Number PH 2.27-1981 (ISO (ASA Speed)) and relates specifically the average of exposure levels required to produce a density of 0.15 above fog in each of the green light sensitive and least sensitive color recording unit of a color film. This definition conforms to the International Standards Organization (ISO) film speed rating. For the purposes of this disclosure, if the color unit gammas differ from 0.65, the ASA or ISO speed is to be calculated by linearly amplifying or de-amplifying the gamma vs. log E (exposure) curve to a value of 0.65 before determining the speed in the otherwise defined manner.

The elements useful in specific embodiments of this invention typically comprise at least one incorporated developing agent that may be supplied in a blocked or unblocked form as known in the art. When supplied in a blocked form, the blocked developing agent can be unblocked on heating as known in the art. Classes of useful developing agents include aminophenols, paraphenylene diamines and hydrazides all as known in the art. Classes of useful blocked developing agents include sulphonamidophenols, carbonamidophenols, carbamylphenols, sulphonamidoanalines, carbonamidoanalines, carbamylanalines, sulphonylhydrazines, carbonylhydrazines, carbamylhydrazines, and such. Other useful blocked developers are described in U.S. patent application Ser. No. 09/475,510 filed Dec. 30, 1999 by Irving et al, the disclosures of which are incorporated by reference. Multiple distinct developing agents can be employed. On heating the developing agent reacts with incorporated oxidant to form oxidized developer. The oxidized developer can then reacts with a color-forming agent to form a non-diffusing dye. In one embodiment, the oxidized developer reacts with a chromogenic coupler to form a non-diffusing dye. In another embodiment the oxidized developer reacts with a leuco-dye to form a non-diffusing dye. In yet another embodiment, the oxidized developer reacts with a color-free dye precursor to liberate a non-diffusing colored dye, all as known in the art. In yet another embodiment, the film has no incorporated color forming chemistry and the developer acts to form imagewise silver deposits. The incorporated oxidant may be any oxidant suitable for reacting with the reduced form of a developing agent. In one embodiment, the sensitized silver halide may serve as the incorporated oxidant. In another embodiment, a distinct metal salt may serve as the incorporated oxidant. In this latter case, organic silver salts as known in the art are preferred. Silver behenate, silver bezotriazole derivatives, silver acetylide derivatives and silver aminoheterocycle derivatives are specifically preferred classes of incorporated oxidants. The element can also include a pH altering base or base precursor as known in the art. Further, the element can include an auxiliary developer or electron transfer agent as known in the art.

A typical color film construction useful in the practice of the invention is illustrated by the following:

Element SCN-1
SOC Surface Overcoat
BU Blue Recording Layer Unit
IL1 First Interlayer
GU Green Recording Layer Unit
IL2 Second Interlayer
RU Red Recording Layer Unit
AHU Antihalation Layer Unit
S Support
SOC Surface Overcoat When the support S is transparent, it can be colorless or tinted and can take the form of any conventional support currently employed in color negative elements, e.g., a colorless or tinted transparent film support so long as it otherwise has the strength and thermal stability properties described above. Details of support construction are well understood in the art. The support is thin enough to enable loading of long lengths in rolled form, while maintaining sufficient strength to resist deformation and tearing during use. The support is generally up to about 180 $\mu$m thick, preferably between 50 and 130 $\mu$m thick, and most preferably between 60 and 110 $\mu$m thick. The support and element flexibility will be such that the element can assume a radius of curvature of less than 12,000 $\mu$m, and preferably less than 6,500 $\mu$m, or even less. Elements useful without cracking or other physical deformity at a radius of curvature of 1,400 $\mu$m or even lower are contemplated. When the element is supplied in cartridge form, the cartridge may enclose a light sensitive photographic element in roll form and a housing for protecting the film element from exposure and an opening for withdrawing the element from the cartridge receptacle. Alternatively, the support S can be reflective. Supports that are relatively reflective to humanly visible light and relatively transparent to infrared light can be preferred. Transparent and reflective support constructions, including subbing layers to enhance adhesion, are disclosed in *Research Disclosure*, Item 38957, cited above, XV. Supports.

Each of blue, green, and red recording layer units BU, GU and RU is formed of one or more hydrophilic colloid layers and contain at least one radiation-sensitive, silver halide emulsion. In one preferred embodiment, the layer units additionally include a color-forming agent, including at least one dye image-forming agent. In the simplest contemplated construction, each of these layer units consists of a single hydrophilic colloid layer containing emulsion. When a color-forming agent is present, it can be in the same layer as an emulsion or a layer in reactive association so as to receive oxidized color developing agent from the emulsion during development.

In order to ensure excellent image sharpness, and to facilitate manufacture and use in cameras, all of the sensitized layers are preferably positioned on a common face of the support. When in spool form, the element will be spooled such that when unspooled in a camera, exposing light strikes all of the sensitized layers before striking the face of the support carrying these layers. Further, to ensure excellent sharpness of images exposed onto the element, the total thickness of the layer units above the support should be controlled. Generally, the total thickness of the sensitized layers, interlayers and protective layers on the exposure face of the support are less than 35 μm. It is preferred that the total layer thickness be less than 28 μm, more preferred that the total layer thickness be less than 22 μm, and most preferred that the total layer thickness be less than 17 μm. This constraint on total layer thickness is enabled by controlling the total quantity light sensitive silver halide as described below, and by controlling the total quantity of vehicle and other components, such as a color forming agents, solvent, and such in the layers. The total quantity of vehicle is generally less than 20 g/m$^2$, preferably less than 14 g/m$^2$, and more preferably less than 10 g/m$^2$. Generally, at least 3 g/m$^2$ of vehicle, and preferably at least 5 g/m$^2$ of vehicle is present so as to ensure adhesion of the layers to the support during processing and proper isolation of the layer components. Likewise, the total quantity of other components is generally less than 12 g/m$^2$, preferably less than 8 g/m$^2$, and more preferably less than 5 g/m$^2$.

In another embodiment, the color forming layers may be applied to both sides of a support to form a duplitized film suitable for use in a camera as described by Szajewski et al U.S. Pat. Nos. 5,744,290 and 5,773,205. This latter arrangement is especially preferred since the engineering constraints around the placement of the light sources and the light sensors of a compound scanner are relieved.

The emulsion in BU is capable of forming a latent image when exposed to blue light. When the emulsion contains high bromide silver halide grains and particularly when minor (0.5 to 20, preferably 1 to 10, mole percent, based on silver) amounts of iodide are also present in the radiation-sensitive grains, the native sensitivity of the grains can be relied upon for absorption of blue light. Preferably the emulsion is spectrally sensitized with one or more blue spectral sensitizing dyes. The emulsions in GU and RU are spectrally sensitized with green and red spectral sensitizing dyes, respectively, in all instances, since silver halide emulsions have no native sensitivity to green and/or red (minus blue) light. Blue-green and green-red sensitive emulsions may also be employed as known in the art. In this context, Blue light is light generally having a wavelength between 400 and 500 nm, Green light is light generally having a wavelength between 500 and 600 nm, and Red light is light generally having a wavelength between 560 and 700 nm.

Any convenient selection from among conventional radiation-sensitive silver halide emulsions can be incorporated within the layer units. Radiation-sensitive, silver chloride, silver bromide, silver iodobromide, silver iodochloride, silver chlorobromide, silver bromochloride, silver iodochlorobromide, and silver iodobromochloride grains may be employed. The grains can be either regular or irregular (e.g., tabular). Tabular grain emulsions in which tabular grains, i.e. those having orthogonal tetragonal faces, account for at least 50 (preferably at least 70 and optimally at least 90) percent of total grain projected area are particularly advantageous for increasing speed in relation to granularity. To be considered tabular, a grain requires two major parallel faces with a ratio of its (equivalent circular diameter (ECD) to its thickness of at least 2. Specifically preferred tabular grain emulsions are those having a tabular grain average aspect ratio of at least 4 and, optimally, greater than 8. Preferred mean tabular grain thicknesses are less than 0.3 μm (most preferably less than 0.2 μm). Ultrathin tabular grain emulsions, those with mean tabular grain thicknesses of less than 0.07 μm, are specifically preferred. The grains preferably form surface latent images so that they produce negative images when processed in a surface developer. While any useful quantity of light sensitive silver, as silver halide, can be employed in the elements useful in this invention, it is preferred that the total quantity be less than 10 g/m$^2$ of silver. Silver quantities of less than 7 g/m$^2$ are preferred, and silver quantities of less than 5 g/m$^2$ are even more preferred. The lower quantities of silver improve the optics of the elements, thus enabling the production of sharper pictures using the elements. These lower quantities of silver are additionally important in that they enable rapid development and desilvering of the elements when that is desired. Conversely, a silver coating coverage of at least 2 g of coated silver per m$^2$ of support surface area in the element is necessary to realize an exposure latitude of at least 2.7 log E while maintaining an adequately low graininess position for pictures intended to be enlarged. The green light recording layer unit is preferred to have a coated silver coverage of at least 0.8 g/m$^2$. It is more preferred that the red and green units together have at least 1.7 g/m$^2$ of coated silver and even more preferred that each of the red, green, and blue color units has at least 0.8 g/m$^2$ of coated silver. Because of its less favored location for processing, it is generally preferred that the layer unit located, on average, closest to the support contain a silver coating coverage of at least 1.0 g/m$^2$ of coated silver. Typically, this is the red recording layer unit. For many photographic applications, optimum silver coverages are at least 0.9 g/m$^2$ in the blue recording layer unit and at least 1.5 g/m$^2$ in the green and red recording layer units.

Illustrations of conventional radiation-sensitive silver halide emulsions are provided by *Research Disclosure*, Item 38957, cited above, Section I. Emulsion grains and their preparation. Chemical sensitization of the emulsions, which can take any conventional form, is illustrated in Section IV. Chemical sensitization. Spectral sensitization and sensitizing dyes, which can take any conventional form, are illustrated by Section V. Spectral sensitization and desensitization. The emulsion layers also typically include one or more antifoggants or stabilizers, which can take any conventional form, as illustrated by Section VII. Antifoggants and stabilizers.

BU can contain at least one yellow dye image-forming agent; GU can contain at least one magenta dye image-forming agent, and RU can contain at least one cyan dye image-forming agent. Any convenient combination of conventional dye image-forming agents can be employed. Magenta dye-forming pyrazoloazole agents are particularly contemplated. Conventional dye image-forming agents are illustrated by *Research Disclosure*, Item 38957, cited above, X. Dye image formers and modifiers, B. Image-dye-forming couplers.

The remaining elements SOC, IL1, IL2, and AHU of the element SCN-1 are optional and can take any convenient conventional form.

The interlayers IL1 and IL2 can be hydrophilic colloid layers having as their primary function color contamination reduction, i.e., prevention of oxidized developing agent from migrating to an adjacent recording layer unit before reacting with dye-forming agent. Art know interlayers having a reflective character can be employed. When color-forming agents are present, the interlayers are in part effective simply by increasing the diffusion path length that oxidized developing agent must travel before reacting with a color-forming agent, thereby improving color discrimination. When the image on such a film is scanned using a compound scanner, the interlayers serve to better isolate the individual silver records for ease of scanning. To increase the effectiveness of the interlayers to intercept oxidized developing agent, it is conventional practice to incorporate an oxidized developing agent scavenger. When one or more silver halide emulsions in GU and RU are high bromide emulsions and, hence, have significant native sensitivity to blue light, it is preferred to incorporate a yellow filter, such as Carey Lea silver or a yellow processing solution decolorizable dye, in IL1. Suitable yellow filter dyes can be selected from among those illustrated by *Research Disclosure*, Item 38957, VIII. Absorbing and scattering materials, B. Absorbing materials. Antistain agents (oxidized developing agent scavengers) can be selected from among those disclosed by *Research Disclosure*, Item 38957, X. Dye image formers and modifiers, D. Hue modifiers/stabilization, paragraph (2).

The antihalation layer unit AHU typically contains a removable or decolorizable light absorbing material, such as one or a combination of parents and dyes. In embodiments specifically designed for compound scanning, the AHU can preferably contain materials that are opaque in the visible region, where the emulsions are sensitized, but transparent in the spectral region where the developed silver images are to be scanned. Suitable materials can be selected from among those disclosed in *Research Disclosure*, Item 38957, VIII. Absorbing materials. A common alternative location for AHU is between the support S and the recording layer unit coated nearest the support.

The surface overcoats SOC are hydrophilic colloid layers that are provided for physical protection of the film elements during handling and processing. Each SOC also provides a convenient location for incorporation of addenda that are most effective at or near the surface of the film element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by *Research Disclosure*, Item 38957, IX. Coating physical property modifying addenda. The SOC overlying the emulsion layers additionally preferably contains an ultraviolet absorber, such as illustrated by *Research Disclosure*, Item 38957, VI. UV dyes/optical brighteners/luminescent dyes, paragraph (1).

Instead of the layer unit sequence of element SCN-1, alternative layer units sequences can be employed and are particularly attractive for some emulsion choices. Using high chloride emulsions and/or thin (<0.2 $\mu$m mean grain thickness) tabular grain emulsions allows interchanges of the positions of BU, GU and RU with reduced blue light contamination of the minus blue records, since these emulsions exhibit negligible native sensitivity in the visible spectrum. For the same reason, it is unnecessary to incorporate blue light absorbers in the interlayers.

When the color layer units are interchanged, it can be useful to provide means of communicating this interchange to the compound scanner and to the algorithms which are employed to combine and optimize the individual color record files into a combined electronic record of the image captured by the film. The magnetic layer of the film and the magnetic reader of described apparatus provide one such communication link. This exchange of information from the film or film container to the compound scanner and algorithms can also be useful when the thickness of the color recording layer units changes as a function of film type. Other useful communication links are described in Szajewski et al U.S. application Ser. No. 09/456,613 "System and Method for Processing and/or Manipulating Images" filed Dec. 8, 1999, the disclosures of which are incorporated by reference.

It is preferred to coat one, two, or three separate emulsion layers within a single color recording layer unit so as to obtain the requisite exposure latitude. When two or more emulsion layers are coated in a single layer unit, they are typically chosen to differ in sensitivity. When a more sensitive emulsion is coated over a less sensitive emulsion a higher speed and longer latitude is realized than when the two emulsions are blended. When a less sensitive emulsion is coated over a more sensitive emulsion, a higher contrast is realized than when the two emulsions are blended. Triple coating, incorporating three separate emulsion layers within a layer unit, is a technique for facilitating extended exposure latitude, as illustrated by Chang et al U.S. Pat. Nos. 5,314,793 and 5,360,703. The use of four or more layers sensitive to the same spectral region is specifically contemplated.

When a layer unit is comprised of two or more emulsion layers, the units can be divided into sub-units, each containing emulsion and a color forming agent, that are interleaved with sub-units of one or both other layer units. The following elements are illustrative:

Element SCN-2
SOC Surface Overcoat
BU Blue Recording Layer Unit
IL1 First Interlayer
FGU Fast Green Recording Layer Sub-Unit
IL2 Second Interlayer
FRU Fast Red Recording Layer Sub-Unit
IL3 Third Interlayer
SGU Slow Green Recording Layer Sub-Unit
IL4 Fourth Interlayer
SRU Slow Red Recording Layer Sub-Unit
S Support
AHU Antihalation Layer Unit
SOC Surface Overcoat Except for the division of the green recording layer unit into fast and slow sub-units FGU and SGU and the red recording layer unit into fast and slow sub-units FRU and SRU, the constructions and construction alternatives are essentially similar to those previously described from element SCN-1. The placement of AHU relative to S and the sensitized layers can vary depending on the decolorizing characteristics of the density forming components incorporated in AHU and on the intended use of the element, all as known in the art. Elements employing multiple AHU layers positioned on both faces of S are specifically contemplated.

Element SCN-3
SOC Surface Overcoat
FBU Fast Blue Recording Layer Unit
IL1 First Interlayer
FGU Fast Green Recording Layer Sub-Unit
IL2 Second Interlayer
FRU Fast Red Recording Layer Sub-Unit
IL3 Third Interlayer
MBU Mid Blue Recording Layer Unit
IL4 Fourth Interlayer
MGU Mid Green Recording Layer Sub-Unit
IL5 Fifth Interlayer
MRU Mid Red Recording Layer Sub-Unit
IL6 Sixth Interlayer
SBU Slow Blue Recording Layer Sub-Unit
IL7 Seventh interlayer
GU Slow Green Recording Layer Sub-Unit
IL8 Eighth Interlayer SRU Slow Red Recording Layer Sub-Unit
AHU Antihalation Layer Unit
S Support
SOC Surface Overcoat Except for the division of the blue, green, and recording layer units into fast, mid, and slow sub-units, the constructions and construction alternatives are essentially similar to those previously described from element SCN-1.

When interleaved layer units are employed, the compound scanner can be designed to specifically monitor silver development by reflection at distinct depths in the film pack so as to allow for color separation.

The following layer order arrangement is useful:

Element SCN-4
SOC Surface Overcoat
FBU Fast Blue Recording Layer Unit
MBU Mid Blue Recording Layer Unit
SBU Slow Blue Recording Layer Sub-Unit
IL1 First Interlayer
FGU Fast Green Recording Layer Sub-Unit
MGU Mid Green Recording Layer Sub-Unit
SGU Slow Green Recording Layer Sub-Unit
IL2 Second Interlayer
FRU Fast Red Recording Layer Sub-Unit
MRU Mid Red Recording Layer Sub-Unit
SRU Slow Red Recording Layer Sub-Unit
IL3 Third Interlayer
AHU Antihalation Layer Unit
S Support
SOC Surface Overcoat Except for the division of the blue, green, and recording layer units into fast, mid, and slow sub-units, the constructions and construction alternatives are essentially similar to those previously described from element SCN-1.

When the emulsion layers within a dye image-forming layer unit differ in speed, it is conventional practice to limit the incorporation of dye image-forming agent in tie layer of highest speed to less than a stoichiometric amount, based on silver. The function of the highest speed emulsion layer is to create the portion of the characteristic curve just above the minimum density, i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed. Other details of film and camera characteristics that are especially useful in the present invention are described by Nozawa at U.S. Pat. No. 5,422,231 and by Sowinski et al at U.S. Pat. No. 5,466,560.

The photographic elements can have density calibration patches or test patches. These can be pre-exposed on or more areas of the film in the form of a reference exposure as described by Wheeler et al U.S. Pat. No. 5,649,260; Koeng et al U.S. Pat. No. 5,563,717; and Cosgrove et al. U.S. Pat. No. 5,644,647.

In the foregoing discussion the blue, green, and red recording layer units are described as optionally containing yellow, magenta, and cyan image dye-forming agents, respectively, as is conventional practice in color negative elements used for printing. In the color elements intended for compound scanning, the actual hue of the image dye produced in the three layer units can be of less significance. What is useful is that the dye image produced in each of the layer units can aid in differentiating the image recorded in that unit from the images recorded by each of the remaining layer units. To provide this capability of differentiation, it is contemplated that each of the layer units can contain one or more dye image-forming agents chosen to produce image dye having an absorption half-peak bandwidth lying in a useful spectral region. When such an arrangement is employed the color used for the transmission and reflection scans can be distinct. By specifically forming specific colors in specific layer units, stray reflections can be minimized thus facilitating the intended scanning. In one embodiment the blue light sensitive layer unit 92 can be formulated to produce a yellow dye along with a silver image, the red light sensitive unit can be formulated to produce a cyan dye along with a silver image and the green light sensitive unit can be formulated to produce a black dye along with a silver image. In this situation, the transmission light source 9 and transmission sensor 15 can each be optimized for the emission and gathering of infrared light, while light source 101 and sensor 103 can be optimized for the emission and gathering of yellow light and light source 105 and sensor 107 can be optimized for the emission and gathering of cyan light. Other useful combination are readily apparent.

Each layer unit of the color elements useful in the invention produces an image characteristic curve having exposure latitude of at least 2.7 log E. A minimum acceptable exposure latitude of a multicolor photographic element is that which allows accurately recording the most extreme whites (e.g., a bride's wedding gown) and the most extreme blacks (e.g., a bridegroom's tuxedo) that are likely to arise in photographic use. An exposure latitude of 2.6 log E can just accommodate the typical bride and groom wedding scene. Accordingly, the elements useful in the practice of this invention exhibit an exposure latitude of at least 2.7 log E. An exposure latitude of at least 3.0 log E is preferred, since this allows for a comfortable margin of error in exposure level selection by a photographer. Even larger exposure latitudes of 3.6 log E are especially preferred for elements preloaded in one-time-use cameras, since the ability to obtain accurate image reproduction with rudimentary exposure control is realized. Whereas in color negative elements intended for printing, the visual attractiveness of the printed scene is often lost when gamma is exceptionally low, when color negative elements are scanned to create electronic image-bearing signals from the dye image records, contrast can be increased by adjustment of the electronic signal information.

It is appreciated that while the element has been described in detail as a negative wording element, similar considerations apply to positive working elements so long as they fulfill the requirements already described. In a concrete example, the element can be made positive working by employing direct reversal emulsions as known in the art.

A suitable thermal film renders an image in response to an imagewise exposure to light upon thermal development. Typical thermal processing conditions involve development temperatures of about 50 to 180° C. for a period of 0.1 to 60 seconds. The film base may be any suitable kind of film base that does not substantially decompose under the processing conditions. Polyethyleneterephthalate (PET), polyethylenenapthalate (PEN), and annealed PEN (APEN) are examples of suitable materials for the film base The accumulator for the film in the apparatus of the invention may be any suitable kind of device. Generally, it is preferred that the drive means drives the cartridge spool to thrust the film from the cartridge and rewind it into the cartridge. However, separate drive means to collect film in an accumulator an to rewind film into a cartridge can also be provided. For compact design, it has been found that having the drive motor within the accumulator itself provides efficiency and compactness. While this is a preferred embodiment, it is not necessary to adequate function of the apparatus, and the drive motor or drive motors may be placed in any position suitable for actuating the thrust cartridge and accumulator to effect transport of the film. The drive motor may be any suitable type of drive motor. Drive motors include AC, DC, and stepper electric motors. Preferred for the apparatus of the invention is a DC electric motor, as this provides a simple means of controlling drive speed. While DC electric motors are preferred in some embodiments, other types of motors or combinations of motors may be used to effect suitable means of driving the film.

The apparatus is provided with means for controlling the speed of the film over the heater. It is also provided with means for determining and controlling the temperature of the heater. It is important for the best photographic performance that the heater be accurately controlled for optimum development temperature. The drive speed, in combination with the heater temperature, provides accurate control of the development process. The heater will be provided with a temperature sensor to determine the instantaneous temperature of the heater. The temperature sensor may be a thermocouple or any other suitable device. Power is supplied to the heater in proportion to a temperature deficiency detected by the temperature sensor. The temperature control circuit uses feedback to maintain and control the temperature of the heater and thereby control the development temperature. The speed of the film over the heater may be controlled by any suitable means of speed control. Pulse width modulation applied to a DC motor that drives both the thrust cartridge and accumulator or timed steps applied to a stepper motor that drives both the thrust cartridge and accumulator are examples of suitable speed control. The motor that drives both the thrust cartridge and the accumulator may be placed within the accumulator for compactness. While this is a preferred embodiment, the drive means may comprise one motor or any combination of motors located in suitable positions within the apparatus of the invention. The film speed is controlled to provide sufficient residence time for the film near the heater and to provide optimal development. The apparatus of the invention typically requires an exposure to the heater for about 2 to 30 seconds to develop a frame of film.

It may be desirable to provide a means to prevent contact of the film with the heater at certain times. For instance, if the device is stopped while film is on the heater, the film could be damaged or improperly developed. To prevent this, the heater could be removed from the film path or the device could be provided with a means to change the film path to be away from the heater. A method for removing the heater from the film path uses an armature connected to a series of gears that are driven by a motor. The motor is controlled to drive the heater away or toward the film path as desired. The motor may be any suitable type of drive motor. Preferred motor for the apparatus of the invention is a stepper electric motor, as this provides a simple means to control the motion of the heater. For compact design, it has been found that having the motor actuating the heater within the accumulator provides efficiency and compactness. While this is a preferred embodiment, it is not necessary to adequate function of the apparatus, and the motor actuating the heater can be placed in any position suitable for moving the heater in close proximity to and removing the heater from the film path.

The motor actuating the heater can be controlled by preset conditions, or it may be constructed to respond to signals provided by sensors monitoring the film and/or development. Sensors may be mounted in the film path to monitor a plurality of parameters including film speed, film location, temperature, frame advancement, and fault conditions such as film breakage, film jam, and heater malfunction. Light emitting diode (LED) sensors are preferred for detection of the position of the image frames in the thermal film. While LED sensors are preferred for the detection of image frame position, the sensors utilized in the apparatus of the invention may be of any suitable type to monitor the parameters of interest. Sensors for the apparatus include optical, magnetic, mechanical, and electronic sensors. The response of such sensors is transmitted to the drive mechanism actuating the heater to place the heater in close proximity to or remove the heater from the film path as desired. In another embodiment, actuated guide rollers are used to lift the film away from the heater when contact between the film and the heater is not desired. The film can also be protected from undue heating by a heater that is sufficiently low in thermal mass and fast in response time to allow the temperature of the heater to be reduced below the damage threshold of the film when necessary.

The apparatus of the invention includes a means for optical scanning. The optical scanner provides an electronic representation of film image information or other information optically encoded on the film. The utility of such an electronic record is widely known in the art. For example, the electronic record of the film image information may be digitized and further processed using various algorithms and communicated to a printing device to yield high quality output prints without requiring optical printing. Typical application of the optical scanner involves scanning thermally processed regions of said thermal film. However, optical scanning may be performed either before or after thermal film has been entirely thermally processed. For example, a test patch of film may be thermally processed and optically scanned and the resulting optical density information may be used to modify subsequent processing conditions. If optical scanning is performed while regions of the film remain unprocessed, care must be taken to ensure that the light source of said scanner does not further expose unprocessed regions of the thermal film. After thermal processing and optical scanning, the film may be rewound back into the thrust cartridge for convenient storage.

The optical scanner may be any suitable type of optical scanner. Preferred for the apparatus of the invention are scanners that faithfully create an electronic record of the film image information. Typical of suitable optical scanners are optical scanners such as disclosed in U.S. Pat. No. 5,684,610—Brandestini et al and by Edgar, op. cit. The apparatus of the invention may be provided with a means to process, modify, store, and retrieve the electronic record of the film image data produced by the optical scanner. The apparatus of the invention may also be provided with a means to process, store, and retrieve the electronic record of the optical scanning parameters associated with the optical scanning of the film. Particularly useful image reconstruction algorithms are described by Edgar at European Publication 0.944.998, and PCT WO 99/43148, PCT WO 99/43149, and PCT WO 99/42954. The apparatus of the invention may be provided with a means to communicate the electronic record of the film image data and/or scanning parameters to other hardware devices including displays, computer systems, and printers and to other electronic communication networks. Optical information may also be recorded on the thermally developable film to be read by the optical scanner and used to control thermal processing conditions or magnetic reading or magnetic writing.

The light source for the optical scanner may be any suitable type. Light sources include incandescent bulbs, fluorescent lamps, and light emitting diodes (LEDs). While this is a particular embodiment, other suitable light sources may be used to effect faithful scanning of the film image information. The light source is provided with controls so that it may be activated and deactivated as appropriate to perform effective optical scanning without interfering with other functions of the invention.

A mirror or mirror system may be provided as part of the optical scanner to redirect the transmitted light. A preferred embodiment of the invention provides a mirror to direct the transmitted light beam to be roughly parallel to the film path for efficiency and compactness. Any suitable and appropriately reflective device may serve as a mirror. Silver coated polished aluminum mirrors are preferred for the apparatus of the invention as silver coated polished aluminum mirrors are robust, low-cost, and appropriately reflective. While silver coated polished aluminum mirrors represent a preferred embodiment, any suitably reflective surface may be used as a mirror in the apparatus of the invention. The mirror may be planar or curved. A non-planar mirror may be used to focus or otherwise modify the beam of transmitted light to improve scanner system performance.

The apparatus of the invention may be provided with a lens or lens system to modify the transmitted light beam. The lens or lens system may be comprised of spherical or non-spherical lenses. Spectral filters may be provided in the light path to: modify the spectral distribution of the incident or transmitted light beam. One embodiment of the invention incorporates liquid-crystal light modulators and/or spectral filters that may be electronically activated and/or mechanically actuated to modify and control the intensity and spectral distribution of the incident and transmitted light. An advantage of this embodiment is that it does not require a color sensitive photoelectronic detector. While this represents one embodiment, the apparatus of the invention does not require liquid-crystal light modulators or mechanically actuated spectral filters. To enhance fidelity and increase efficiency, all optical interfaces may be anti-reflection coated as is known in the art.

The photosensitive detector may be any suitable type of device capable of faithfully producing an electronic signal in response to incident light. Solid-state detectors and photomultiplier tubes are examples of suitable photosensitive elements. Preferred for the apparatus of the invention are solid state detectors. Charge coupled devices (CCD) or complementary metal oxide semiconductors (CMOS) are particular examples of suitable solid-state photoelectronic detectors. The detectors may be combined in a linear array so that stripes of the film corresponding to the length of the linear array are scanned simultaneously. For example, two-dimensional array detectors may be utilized to simultaneously scan larger areas of the film than tri-linear arrays. This would allow faster film feed rates and provide for more rapid scanning. Large two-dimensional array detectors may be used to simultaneously scan an entire film image frame.

The apparatus may be provided with controls for the optical scanner. The capability to perform optical scanning in response to information stored electronically, magnetically, or optically on the thermally developable film or the thrust cartridge or information provided by some other source is important to achieve optimal optical scanning. Parameters such as desired resolution, film type, and expected optical density range may be communicated to the optical scanner so that the scanning parameters may be altered to produce advantaged optical scans and prevent interference between optical scanning and other functions of the invention such as thermal processing or magnetic information reading or writing.

The magnetic reader may be any suitable type of magnetic reader. Preferred for the apparatus of the invention are inductive type laminated mu-metal core with a coil magnetic readers as such magnetic readers provide a low-cost and robust means to read magnetic information stored on film while minimizing noise and controlling cross talk. The magnetic reader may be located anywhere in the film path. Locating the magnetic reader so that the magnetic information is read before the film is thermally processed is preferred as this allows the processing conditions to be controlled in response to the magnetic information and avoids potential degradation of the magnetic information associated with the thermal processing. Multiple magnetic readers may be included so that magnetic information is read at a variety of locations in the film path. The apparatus of the invention also contains means to store, transmit, and record electronic information. Specifically the apparatus of the invention contains means to store, transmit, and process the electronic record of the magnetic information sensed by the magnetic reader. This electronic record may be used to control or modify subsequent processes such as thermal processing, optical printing, or optical scanning. The capability to perform subsequent processing in response to information stored magnetically on the film is important to optimal imaging system performance. For example, since different thermal film formulations generally require different thermal processing conditions to achieve optimal development, controlling the heater and film drive speed in response to film type information that may be stored magnetically on the film is important to achieve optimal development and subsequent image quality.

The magnetic writer may be any suitable type of magnetic writer. Preferred for the apparatus of the invention are inductive type laminated mu-metal core with a coil magnetic writers as such magnetic writers provide a low-cost and robust means to write magnetic information onto film. The magnetic writer may be located anywhere in the film path. Locating the magnetic writer so that the magnetic information is written after the film is thermally processed is preferred as this avoids potential degradation of the magnetic information associated with the thermal processing. Multiple magnetic writers may be included so that magnetic information is written at a variety of locations in the film path. The magnetic writer can write any type of information that may be encoded magnetically. Specifically the magnetic writer may rewrite data previously stored on the film or film cartridge or the magnetic writer may write new information onto the film such as the processing conditions or the date of processing. Such information is used to optimize subsequent processing. For example, advantaged optical scanning results from adjusting optical scanning parameters to provide for expected density values based on the processing conditions.

A preferred embodiment of the apparatus of the invention requires magnetic information to be written onto the film in positions that are known relative to other elements on the film such as imaging frames. A preferred means of determining the image frame position comprises light emitting diode (LED) sensors and perforations in the film spaced at regular intervals relative to the imaging frames. Writing the magnetic information onto regions of the film in registry with the imaging frames allows frame specific information to be more accurately and immediately applied to individual frames resulting in improved system efficiency.

The magnetic writer may be combined with the magnetic reader into a single assembly or they may be separate. The magnetic reader and the magnetic writer may be mounted together or separately on one or more armatures which may be actuated to remove the magnetic reader or the magnetic writer from the film path. The motor actuating an armature may be controlled by preset conditions, or it may be constructed to respond to signals provided by sensors monitoring the film and/or development. Sensors may be mounted in the film path to monitor at plurality of parameters including film speed, film location, temperature, frame advancement, and fault conditions such as film breakage, film jam, and heater malfunction. The armature mechanism may be constructed so that the magnetic reader and the magnetic writer are actuated simultaneously or independently. Retraction of the magnetic reader and/or the magnetic writer is of utility to avoid unwanted interference with other processing steps such as thermal development or optical scanning. Specifically, contact between the magnetic reader and/or the magnetic writer and the thermal film may prevent the film from optimally engaging the heater or optical scanner. Removing the magnetic reader and/or the magnetic writer from the film path avoids such detrimental interference. The armature mechanism may be constructed to return the magnetic reader or magnetic writer to the film path after the magnetic reader or magnetic writer has been removed from the film path.

The apparatus of the invention may be provided with a means to erase any magnetic information stored on the film. The device used to erase the magnetic information may be any suitable type of device. The magnetic eraser may be located anywhere in the film path. Locating the magnetic eraser so that the magnetic information is erased after the film is thermally processed but before magnetic information is rewritten onto the film is preferred, as this allows potentially degraded magnetic information to be discarded and further allows for more effective writing of magnetic information by the magnetic writer. The magnetic eraser may also allow the magnetic writer to write magnetic information in a more efficient or useful format than originally present on the film.

The apparatus of the invention may be provided with a means to preserve the magnetic information through the thermal processing conditions. The magnetic information may be preserved through the thermal processing conditions by insulating regions of the film containing the magnetic information from the temperature extremes of the thermal process. This may be accomplished by providing power to the heater only when the regions of the film containing magnetic information are in positions so as not to be overly subject to the temperature extremes of thermal development. Magnetic information stored on the film may also be substantially preserved if the regions of the film containing magnetic information are cooled while other regions of the film are exposed to thermal development. The device used to cool the magnetic regions of the film may be any suitable type of device. Preferred for the apparatus of the invention are thermoelectric coolers as thermoelectric coolers provide for compact and localized cooling without requiring a working fluid or compressor.

The leader for the thermal film should maintain its dimensional stability during processing of the film. The film can misfeed in the film path if the leader exhibits excessive curl, warp, or twist, or expands or contracts excessively under the conditions of the thermal processing. The leader is critical to the repeated use of the developed film in the thrust cartridge. A degraded or unsuitable leader prevents the film from smoothly traversing the film path and results in excessive wear of the film including scratching of the image elements. Repeated use of a thrust cartridge containing film with an unsuitable leader will also cause the thrust cartridge to fail so that the film can no longer be thrust from or rewound into the thrust cartridge. To avoid these problems, the leader may either be protected from the heat extremes of development or be formed of a material that is dimensionally stable at the temperatures of development of up to 180° C. The leader is protected from the heat extremes of development by removing the heater element from the film path until the leader has passed and is no longer in close proximity to the heater. The heater is then placed back into the film path as necessary to process the imaging frames. Suitable actuation of the heater may be provided by a variety of electromotive sub assemblies. In another embodiment, power is supplied to the heater only if the leader is not in close proximity to the heater, thereby insulating the leader from the heat extremes of thermal development. Insulating the leader from the heating element is not required if the leader is comprised of a material that maintains sufficient dimensional stability through the process conditions. To prevent unwanted distortion of the image, the film base need also remain stable through the processing conditions. The typical developing temperatures for color thermal film are likely to be between 50 and 180° C. Therefore, any suitable material that maintains sufficient dimensional stability through these process conditions could be used as the leader or film base material. Polyethyleneterephthalate (PET) and polyethylene naphthalate (PEN) can be used as a leader and film base provided the exposure to the highest temperature processing conditions is not excessive. Annealed PEN can be preferred.

The device can be of any size that is adequate to house the cartridge, heater, and drive mechanisms. It is preferred that the invention apparatus be made as compact as possible. It is considered desirable that the apparatus be of such a size that it may be fit into a drive bay of a computer. Typically, the lighttight container of the apparatus of the invention would have a volume of less than 1200 $cm^3$. By the container being lighttight is meant that the container can exclude light to which the film is sensitive. For typical films intended for consumer applications, this means ultraviolet, red, green, and blue light.

The power for the apparatus of the invention may be any suitable source. It may be provided with a means to be plugged into a standard electrical outlet. If the device is installed in a computer or as a computer peripheral device, it could draw power from the computer. The apparatus of the invention does not require many of the resources necessary to traditional wet-process photofinishing. It, therefore, allows more convenient photofinishing than traditional wet-processes. It is contemplated that the apparatus of the invention will find application in more widely dispersed settings, such as home or small office use, than traditional wet-process photofinishing. It is further contemplated that the device of the invention will allow photofinishing in remote locations lacking resources, such as contaminant free water and means to treat contaminated effluent, necessary for traditional wet processing. A battery could be utilized as the power source in a remote location for rapid and convenient processing of exposed film.

Any suitable output device may be used to provide viewable images from the film and compound scanner utilized in the invention. The devices include those for optical display and for forming hard copies.

Ink jet printers suitable for use are described in U.S. patent application Ser. Nos. 08/934,370 and 09/105,743 of Wen. These printers are capable of rapidly producing high quality, durable prints. The printer comprises control electronics, print head drive electronics, ink jet print heads for printing at least black, cyan, magenta, and yellow inks, and corresponding ink reservoirs for providing color inks to the print heads. Inks based on dye or pigment colorants may be used. It is specifically contemplated to use more than four inks to improve image quality and productivity. For example, a six-ink system of cyan, light cyan, magenta, light magenta, yellow, and black may be used. Alternatively, a six-ink system of cyan, magenta, yellow, orange, green, and black may be used. The ink jet printing apparatus further includes a receiver transport motor and a roller for transporting an ink receiver across a platen past the inkjet print heads. The print heads can take various forms known in the art, for example, piezo-electric or thermal ink jet print head. An example of such a print head is shown in Braun U.S. Pat. No. 5,598,196. Various methods may be used to accelerate drying of the ink jet prints. It is specifically contemplated that prints may be dried by the same heating element used for film processing, in which case a transporting means would be provided to move prints from the printer to the heater and out to a print sorter.

The ink jet printer can employ various means of providing durable, water-resistant prints. Images can be laminated with a clear plastic material. The formation of images with radiation curable inks, as described in U.S. patent application Ser. No. 08/934,370 of Wen, can be used. Image can be protected with pre-or post-printing delivery to the print of a fluid layer that subsequently hardens, as described in U.S. Ser. No. 09/934,370 of Wen. The printer can employ thermal fusing of ink jet media with fusible top layer, as described by Misuda et al European Patent Applications 858,905 A1 and 858,906 A1 The prints may also be protected via coating of a latex resin, as described by Ogawaa et al U.S. Pat. No. 5,376,434.

Electrostatic, laser, and Xerographic image display engines are specifically contemplated.

Dye-donor elements conventionally comprise a support having thereon a dye-containing layer. Any dye can be used in the dye-donor employed in the invention provided it is transferable to the dye-receiving layer by the action of heat. Especially good results have been obtained with sublimable dyes. Dye donors applicable for use in the present invention are described, e.g., in U.S. Pat. Nos. 4,916,112; 4,927,803; and 5,023,228.

As noted above, dye-donor elements are used to form a dye transfer image. Such a process comprises imagewise-heating a dye-donor element and transferring a dye image to a dye-receiving element as described above to form the dye transfer image.

In a preferred embodiment, a dye-donor element is employed which comprises a polyethylene terephthalate support coated with sequential repeating areas of cyan, magenta, and yellow dye, and the dye transfer steps are sequentially performed for each color to obtain a three-color dye transfer image. Of course, when the process is only performed for a single color, then a monochrome dye transfer image is obtained.

Thermal printing heads which can be used to transfer dye from dye-donor elements to the receiving elements are available commercially. There can be employed, for example, a Fujitsu Thermal Head (FTP040 MCS001), a TDK Thermal Head F415 HH7-1089 or a Rohm Thermal Head KE 2008-F3. Alternatively, other known sources of energy for thermal dye transfer may be used, such as lasers as described in, for example, GB No. 2,083,726A.

A thermal dye transfer assemblage comprises (a) a dye-donor element, and (b) a dye-receiving element as described above, the dye-receiving element being in a superposed relationship with the dye-donor element so that the dye layer of the donor element is in contact with the dye image-receiving layer of the receiving element.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The digital records derived from the thermal imaging films may also be reduced to a viewable form by the utilization of silver halide imaging technology. The digital records are printed unto silver halide materials utilizing a digital printer. The digital printer may use conventional wet processed silver halide color imaging materials. The digital printer also may utilize thermal dye transfer imaging materials that utilize silver halide materials, or the silver halide print material may be a thermal processed material that utilizes light insensitive silver salts as described Inoue U.S. Pat. No. 5,819,130. It is also possible that ink jet technology may be utilized to supply processing solutions to a silver halide material as described in U.S. Pat. Nos. 5,832,328 (Ueda), 5,701,540 (Ueda et al), 5,758,223 (Kobayashi et al), 5,766,832 (Nishio), and 5,698,382 (Nakahanada et al).

The images from the thermal imaging films that are made into digital records also may be viewed on conventional computer monitors and television screens. They also may be observed on liquid crystal displays (LCDs), light emitting diode (LED) displays, and other digitally driven visual display devices as known in the art.

The thermal film and processor of the invention also may be utilized as part of a stand-alone imaging station that would allow the user to put their pre-exposed and processed thermal imaging film into the station or their pre-exposed and unprocessed film into the station for processing, and then print, transmit, store, or display images from the film in any suitable manner. The components and characteristics of such a station are described in U.S. Pat. Nos. 5,113,351 (Bostic), 5,627,016 (Manico), and 5,664,253 (Meyers).

The following examples illustrate the practice of this invention. They are not intended to be exhaustive of all possible variations of the invention. Parts and percentages are by weight unless otherwise indicated.

EXAMPLES

Example 1

A full color heat developable film (A) is prepared. Light-Sensitive Silver Halide Emulsion (1) [for Red Sensitive Emulsion Layer].

Solution (1) and solution (2) shown in Table 1 are concurrently added to a well-stirred aqueous solution of gelatin (a solution of 16 g of gelatin, 0.24 g of potassium bromide, 1.6 g of sodium chloride, and 24 mg of compound (a) in 540 ml of water heated at 55° C.) at the same flow rate for 19 minutes. After 5 minutes, solution (3) and solution (4) shown in Table 1 are further concurrently added thereto at the same flow rate for 24 minutes. After washing and salt removal by a conventional method, 17.6 g of lime-treated ossein gelatin and 56 mg of compound (b) are added to adjust the pH and the pAg to 6.2 and 7.7, respectively. Then, 1.02 mg of trimethylthiourea are added, followed by optimum chemical sensitization at 60° C. Thereafter, 0.18 g of 4-hydroxy-6-methyl-1,3,3a,7-tetraazainedene, 64 mg of sensitizing dye (C) and 0.41 g of potassium bromide are in turn added, followed by cooling. Thus, 590 g of a monodisperse cubic silver chlorobromide emulsion having a mean grain size of 0.30 $\mu$m is obtained.

TABLE 1

| | Solution (1) | Solution (2) | Solution (3) | Solution (4) |
|---|---|---|---|---|
| $AgNO_3$ | 24.0 g | — | 56.0 g | — |
| $NH_4NO_3$ | 50.0 mg | — | 50.0 mg | — |
| KBr | — | 10.9 g | — | 35.3 g |
| NaCl | — | 2.88 g | — | 1.92 g |
| $K_2IrCl_6$ | — | 0.07 mg | — | — |
| Amount Completed | Water to make 130 ml | Water to make 200 ml | Water to make 130 ml | Water to make 200 ml |

Compound (a)

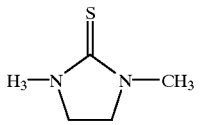

Compound (b)

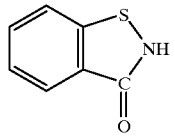

Dye (C)

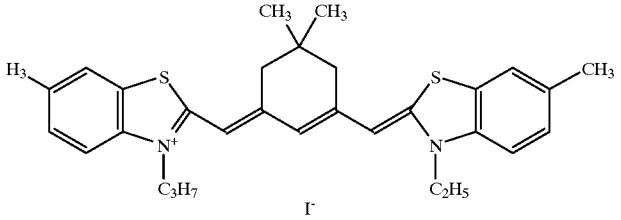

Light-Sensitive Silver Halide Emulsion (2) [for Green Sensitive Emulsion Layer].

Solution (1) and solution (2) shown in Table 2 are concurrently added to a well-stirred aqueous solution of 5% gelatin (a solution of 20 g of gelatin, 0.30 g of potassium bromide, 2.0 g of sodium chloride, and 30 mg of compound (a) in 600 ml of water heated at 46° C.) at the same flow rate for 10 minutes. After 5 minutes, solution (3) and solution(4) shown in Table 2 are further concurrently added thereto at the same flow rate for 30 minutes. One minute after termination of addition of solutions (3) and (4), 600 ml of a solution of sensitizing dyes in methanol containing 360 mg of sensitizing dye ($d_1$) and 73.4 mg of sensitizing dye ($d_2$) is added. After washing and salt removal (conducted using sedimenting agent (e) at pH 4.0) by a conventional method, 22 g of lime-treated ossein gelatin is added to adjust the pH and pAg to 6.0 and 7.6, respectively. Then 1.8 mg of sodium thiosulfate and 180 mg of 4-hydroxy-6-methyl-1,3,3a,7-tetraazainedene are added, followed by optimum chemical sensitization at 60° C. Thereafter, 90 mg of antifoggant (f) and 70 mg of compound (b) and 3 ml of compound (g) as preservatives are added, followed by cooling. Thus, 635 g of a monodisperse cubic silver chlorobromide emulsion having a mean grain size of 0.30 $\mu$m is obtained.

TABLE 2

| | Solution (1) | Solution (2) | Solution (3) | Solution (4) |
|---|---|---|---|---|
| $AgNO_3$ | 10.0 g | — | 90.0 g | — |
| $NH_4NO_3$ | 60.0 mg | — | 380 mg | — |
| KBr | — | 3.50 g | — | 57.1 g |
| NaCl | — | 1.72 g | — | 3.13 g |
| $K_2IrCl_6$ | — | — | — | 0.03 mg |

TABLE 2-continued

| | Solution (1) | Solution (2) | Solution (3) | Solution (4) |
|---|---|---|---|---|
| Amount Completed | Water to make 26 ml | Water to make 131 ml | Water to make 280 ml | Water to make 289 ml |

Dye ($d_1$)

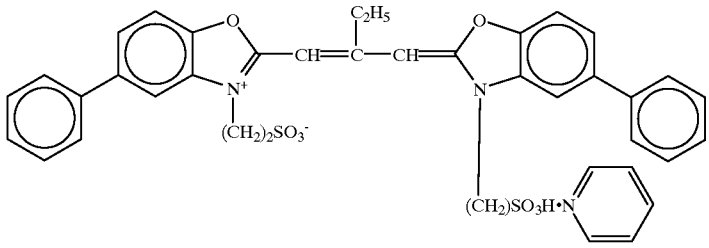

Dye ($d_2$)

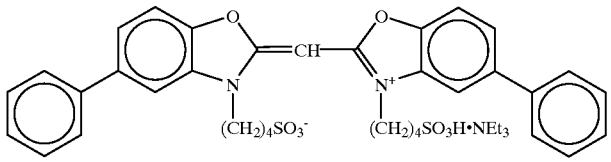

Sedimenting agent (e)

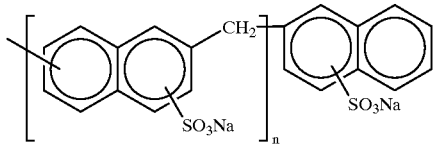

Antifoggant (f)

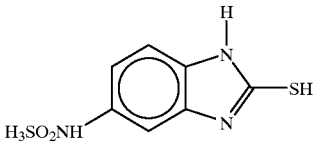

Compound (g)

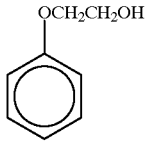

Light-Sensitive Silver Halide Emulsion (3) [for Blue Sensitive Emulsion Layer].

First, addition of solution (2) shown in Table 3 to a well-stirred aqueous solution of 5% gelatin (a solution of 31.6 g of gelatin, 2.5 g of potassium bromide, and 13 mg of compound (a) in 584 ml of water heated at 70° C.) is started. After 10 minutes addition of solution (1) is started. Solutions (1) and (2) are thereafter added for 30 minutes. Five minutes after termination of addition of solution (2), addition of solution (4) shown in Table 3 is further started, and after 10 seconds, addition of solution (3) is started. Solution (3) was added for 27 minutes and 50 seconds, and solution (4) is added for 28 minutes. After washing and salt removal (conducted using sedimenting agent (e') at pH 3.9) by a conventional method, 24.6 g of lime treated ossein gelatin and 56 mg of compound (b) are added to adjust the pH and the pAg to 6.1 and 8.5, respectively. Then 0.55 mg of sodium thiosulfate is added, followed by optimum chemical sensitization at 65° C. Thereafter, 0.35 g of sensitizing dye (h), 56 mg of antifoggant (i), and 2.3 ml of compound (g) as a preservative are added, followed by cooling. Thus, 582 g of a monodisperse octahedral silver bromide emulsion having a mean grain size of 0.55 $\mu$m is obtained.

TABLE 3

| | Solution (I) | Solution (2) | Solution (3) | Solution (4) |
|---|---|---|---|---|
| $AgNO_3$ | 15.8 g | — | 72.2 g | — |
| $NH_4NO_3$ | 68.0 mg | — | 308 mg | — |
| KBr | — | 11.4 g | — | 52.2 g |
| Amount Completed | Water to make 34 ml | Water to make 134 ml | Water to make 194 ml | Water to make 195 ml |

Sedimenting Agent (e')

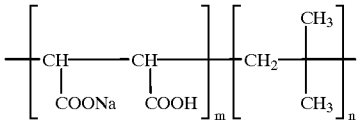

m + n = 1

Dye (h)

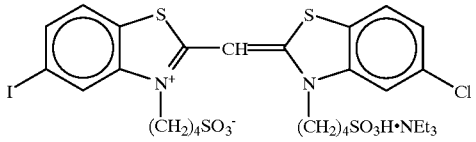

Antifoggant (i)

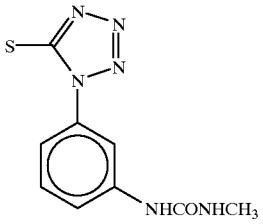

Benzotriazole Silver Emulsion (Organic Silver Salt)

In 300 ml of water, 28 g of gelatin and 13.2 g of benzotriazole are dissolved. The resulting solution was maintained at 40° C. and stirred. A solution of 17 g of silver nitrate in 100 ml of water is added to this solution for 2 minutes. The pH of the resulting benzotriazole silver emulsion is adjusted to remove excess salts by sedimentation. Then the pH is adjusted to 6.30 to obtain 400 g of a benzotraizole silver emulsion.

Method for Preparing Emulsified Dispersions of Couplers.

The oil phase ingredients and aqueous phase ingredients shown in Table 4 are each dissolved to form homogeneous solutions having a temperature of 60° C. Both the solutions are combined and dispersed in a 1-liter stainless steel vessel with a dissolver equipped with a 5 cm diameter disperser at 10,000 rpm for 20 minutes. Then hot water is added in amounts shown in Table 4 as post water addition, followed by mixing at 2,000 rpm for 10 minutes. Thus, emulsified dispersions of three colors of cyan, magenta, and yellow are prepared.

TABLE 4

| | | Cyan | Magenta | Yellow |
|---|---|---|---|---|
| Oil Phase | Cyan Coupler (1) | 4.64 g | — | — |
| | Magenta Coupler (2) | — | 3.18 g | — |
| | Yellow Coupler (3) | — | — | 2.96 g |

TABLE 4-continued

| | | Cyan | Magenta | Yellow |
|---|---|---|---|---|
| | Developing Agent (4) | 1.78 g | 1.78 g | 1.78 g |
| | Antifogant (5) | 0.08 g | 0.08 g | 0.08 g |
| | igh Boiling solvent (6) | 4.08 g | 4.85 g | 3.83 g |
| | Ethyl Acetate | 24 ml | 24 ml | 24 ml |
| Aqueous Phase | Lime-Treated Gelatin | 5.0 g | 5.0 g | 5.0 g |
| | Surfactant (7) | 0.40 g | 0.40 g | 0.40 g |
| | Water | 75.0 ml | 75.0 ml | 75.0 ml |
| | Post Water Addition | 60.0 ml | 60.0 ml | 60.0 ml |

Cyan Coupler (1)

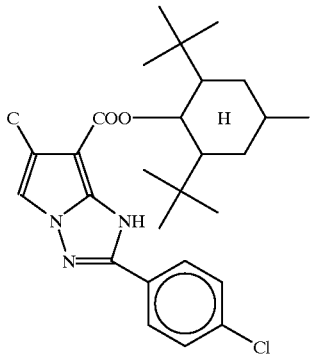

Magenta Coupler (2)

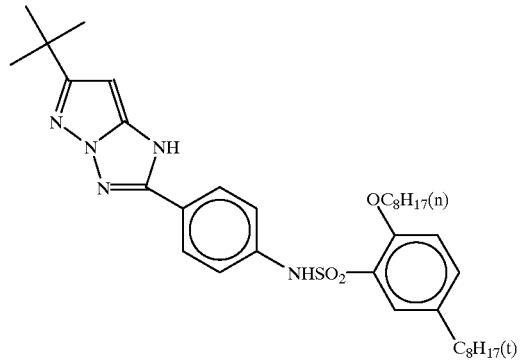

Yellow Coupler (3)

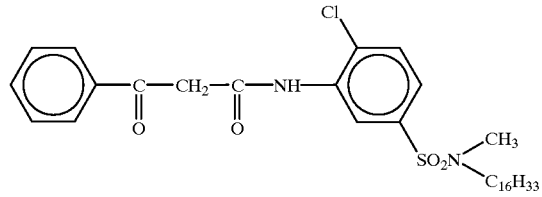

Developing Agent (4)

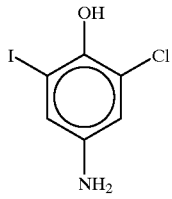

TABLE 4-continued

| | Cyan | Magenta | Yellow |
|---|---|---|---|

Antifoggant (5)

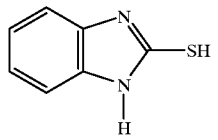

High Boiling Solvent (6)

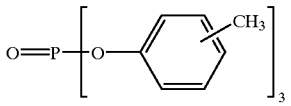

Surfactant (7)

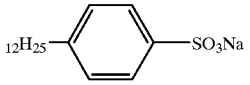

Using the material thus obtained, heat development color photographic material having the multilayer constitution shown in Table 5 is prepared. Annealed polyethylenenapthalate (APEN) containing an effectively transparent coating of magnetic particles suitable for use as a magnetic recording medium is used as a film base.

TABLE 5

| Layer Constitution | Material Added | Amount Added (mg/m$^2$) |
|---|---|---|
| 6th Layer Protective Layer | Lime-Treated Gelatin | 1940 |
| | Matte Agent (Silica) | 200 |
| | Surfactant (8) | 50 |
| | Surfactant (9) | 300 |
| | Base Precursor (10) | 1400 |
| | Water-Soluble Polymer (11) | 120 |
| 5th Layer Yellow Color Forming Layer | Lime-Treated Gelatin | 2000 |
| | Blue-Sensitive Silver Halide Emulsion | 1250 (converted to silver) |
| | Benzotriazole Silver Emulsion | 300 (converted to silver) |
| | Yellow Coupler (3) | 600 |
| | Developing Agent (4) | 360 |
| | Antifoggant (5) | 16 |
| | High Boiling Solvent (6) | 774 |
| | Surfactant (7) | 80 |
| | Heat Solvent (12) | 1400 |
| | Surfactant (9) | 70 |
| | Water-Soluble Polymer (11) | 40 |
| 4th Layer Intermediate Layer | Lime-Treated Gelatin | 970 |
| | Surfactant (8) | 50 |
| | Surfactant (9) | 300 |
| | Base Precursor (10) | 1400 |
| | Water-Soluble Polymer (11) | 60 |
| 3rd Layer Magenta Color Formation Layer | Lime-Treated Gelatin | 1000 |
| | Green-Sensitive Silver Halide Emulsion | 625 (converted to silver) |
| | Benzotriazole Silver Emulsion | 150 (converted to silver) |
| | Magenta Coupler (2) | 320 |
| | Developing Agent (4) | 180 |
| | Antifoggant (5) | 8 |
| | High Boiling Solvent (6) | 490 |
| | Surfactant (7) | 40 |
| | Heat Solvent (12) | 700 |
| | Surfactant (9) | 35 |
| | Water-Soluble Polymer (11) | 20 |
| 2nd Layer Intermediate Layer | Lime-Treated Gelatin | 970 |
| | Surfactant (8) | 50 |
| | Surfactant (9) | 300 |
| | Base Precursor (10) | 1400 |
| | Water-Soluble Polymer (11) | 60 |
| 1st Layer Cyan Color Formulation Layer | Lime-Treated Gelatin | 1000 |
| | Red-Sensitive Silver Halide Emulsion | 625 (converted to silver) |
| | Benzotriazole Silver Emulsion | 150 (converted to silver) |
| | Cyan Coupler (1) | 470 |
| | Developing Agent (4) | 180 |
| | Antifoggant (5) | 8 |
| | High Boiling Solvent (6) | 410 |
| | Surfactant (7) | 40 |
| | Heat Solvent (12) | 700 |
| | Surfactant (9) | 35 |
| | Water-Soluble Polymer (11) | 20 |
| Transparent Base (102 μm) | | |

Surfactant (8)

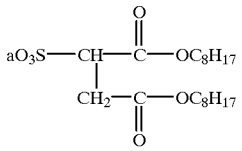

Surfactant (9)

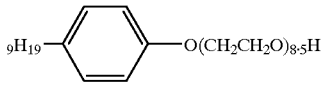

Base Precursor (10)

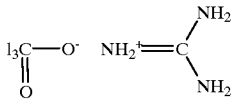

Water-Soluble Polymer (11)

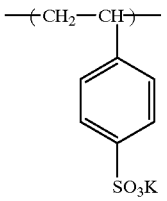

Heat Solvent (12)
D-Sorbitol

This film is loaded in a thrust cartridge, and the thrust cartridge is inserted into a camera and imagewise exposed to a full color test scene. The film is then rewound into the thrust cartridge, removed from the camera, and inserted into the chamber for accepting the thrust cartridge of the apparatus of the invention. The lighttight door of the apparatus of this invention is closed and the film drive mechanism is activated to thrust the film along the film path into the accumulator. The magnetic reader reads magnetic information stored on the film. The electronic record of this magnetic information is used to control and modify the thermal processing conditions and the electronic record of the magnetic information is stored in an electronic storage device. The temperature of the heater is adjusted and set in accordance to the magnetic information stored on the film. The drive speed is adjusted to provide for a development time in accordance to the magnetic information stored on the film. The film is driven past the heater to effect thermal development. The processed film is then driven past the magnetic writer that writes magnetic information onto the film. The film is then driven past the illuminated light source of the compound scanner. The color records of the developed film are measured by the combination of transmission and reflection scans using the compound scanner and infrared light to produce three electronic files, one for each color record. The compound scanner also reads a preexposed calibration patch to form a calibration correction file. The three distinct color record files are digitized and combined to form a first digital file representative of the image. This first digital file is further refined by combination with the calibration correction file to form a second digital file. This electronic file is displayed on a CRT to allow preview of the captured image. This electronic file is further manipulated to align color and tone scale to a specific digital print engine. The file is output to an ink-jet printer. Inspection of the print reveals that the full color image scene is faithfully reproduced by this photothermographic system. The film is rewound into the thrust cartridge and removed from the apparatus of the invention.

The invention has been described in detail with particular reference to certain preferred ,embodiments thereof, but it will be understood that variations and modifications can be effected within the spirit and scope of the invention.

What is claimed is:

1. An apparatus for thermal development comprising:

a receiver for receiving an imagewise exposed thermal film element;

an accumulator for gathering the film;

a drive for advancing the film from the receiver to the accumulator;

a heater located between the receiver and the accumulator for developing the film as it passes between the receiver and the accumulator;

a compound image scanner for scanning the film after it has been thermally developed, the scanner having a first light source and a first sensor placed for forming a first electronic record of the image formed on the developed thermal film by reflection, a second light source and a second sensor placed for forming a second electronic record of the image formed on the developed thermal film by an opposing reflection, and a third sensor and a third light source placed for forming a third electronic record of the image formed on the developed thermal film by transmission; wherein the third sensor may be the same or different than the first sensor and the third light source may be the same or different than the second light source; and a lighttight container for the receiver and the heater.

2. The apparatus of claim 1 wherein the receiver is a receiving chamber for a thrust cartridge, and the drive is a thrust cartridge drive suitable for advancing film from a thrust cartridge and rewinding the film into the thrust cartridge.

3. The apparatus of claim 1 wherein the first, second, and third scanner light sources emit infrared radiation and the first, second, and third scanner sensors respond to infrared radiation.

4. The apparatus of claim 1 wherein the lighttight container further contains at least one of the accumulator and the scanner.

5. The apparatus of claim 1 wherein the apparatus further includes means for magnetic reading of the thermal film or magnetic writing to the thermal film.

6. The apparatus of claim 1 wherein the apparatus further comprises a digitizer fed by the scanner and suitable for digitizing the first, second, and third electronic records to form corresponding digital file representations of an image formed on a film by exposure and thermal development.

7. The apparatus of claim 6 further comprising means for storing, combining, and processing distinct digital files to form a corrected digital file representation of the scanned film image and means for storing, transmitting, displaying, or printing the corrected digital file.

8. A method of forming an electronic record of an image from an imagewise exposed thermal film element delivered to the receiver of an apparatus according to claim 1, said method comprising the steps of:

advancing the film from the receiver;

taking up the film in an accumulator;

thermally developing the film as it passes over a heater located between the receiver and the accumulator; and scanning the film after it has been thermally developed to form a first electronic record of the image formed on the developed thermal film by reflection, a second electronic record of the image formed on the developed thermal film by an opposing reflection, and a third electronic record of the image formed on the developed thermal film by transmission.

9. The method of claim 8 wherein the receiver is a receiving chamber for a thrust cartridge, and the drive is a thrust cartridge drive suitable for advancing film from a thrust cartridge and rewinding the film into the thrust cartridge and the thrust cartridge drive advances the film from the thrust cartridge.

10. The method of claim 8 further having the step of maintaining the heater at between 50 to 180° C.

11. An image forming method comprising the step of scanning an imagewise exposed and thermally developed silver halide film element to form a first electronic record of the image formed on the developed thermal film by reflection, a second electronic record of the image formed on the developed thermal film by an opposing reflection, and a third electronic record of the image formed on the developed thermal film by transmission.

12. The method of claim 11 wherein said scanning step employs infrared light.

13. The method of claim 11 further having the step of digitizing each electronic record to form a corresponding digital file representation of an image formed on the film by exposure and thermal development.

14. The method of claim 13 further having the steps of combining and processing the distinct digital files to form a first corrected digital file representative of the scanned image.

15. The method of claim 14 further comprising the step of storing, transmitting, displaying, or printing the corrected digital file.

16. The method of claim 11 having the step of regulating scanning of the image utilizing resident electronic signal processing and memory.

17. The method of claim 14 further having the steps of:

scanning a thermally developed pre-exposed patch of known exposure characteristics to form a correction file; and combining and processing the distinct digital files and the correction file to form a second corrected digital file representative of the scanned image.

18. An image forming method comprising the step of scanning an imagewise exposed and developed light sensitive silver halide color film element;

said element comprising red, green, and blue light sensitive layer units, wherein the layer units form reflective images of substantially similar color on development or wherein the element is substantially free of color forming components;

to form a first electronic record of the image formed on the developed film by reflection, a second electronic record of the image formed on the developed film by an opposing reflection, and a third electronic record of the image formed on the developed film by transmission.

* * * * *